United States Patent [19]

Yokoi et al.

[11] 4,438,926

[45] Mar. 27, 1984

[54] TIMEPIECE APPARATUS HAVING A GAME FUNCTION

[75] Inventors: Gunpei Yokoi, Kyoto; Satoru Okada, Osaka, both of Japan

[73] Assignee: Nintendo Co., Ltd., Kyoto, Japan

[21] Appl. No.: 161,344

[22] Filed: Jun. 20, 1980

[30] Foreign Application Priority Data

Feb. 28, 1980 [JP] Japan ..... 55-24836
Apr. 4, 1980 [JP] Japan ..... 55-44999

[51] Int. Cl.[3] ..... A63F 9/00

[52] U.S. Cl. ..... 273/85 G; 273/313; 273/138 A; 368/10

[58] Field of Search ..... 273/138 A, 856, 316, 273/313; 368/10, 96

[56] References Cited

U.S. PATENT DOCUMENTS

| | | | |
|---|---|---|---|
| 3,337,218 | 8/1967 | Hurley | 273/85 G |
| 4,008,893 | 2/1977 | Yoseloff | 273/85 G |
| 4,162,792 | 7/1979 | Chang et al. | 273/85 G |
| 4,188,779 | 2/1980 | Fatton | 273/138 A |
| 4,231,090 | 10/1980 | Fatton | 273/138 A |
| 4,249,734 | 2/1981 | Bromley | 273/94 |

FOREIGN PATENT DOCUMENTS

| | | | |
|---|---|---|---|
| 54-14840 | 2/1979 | Japan | 273/138 A |

OTHER PUBLICATIONS

"*Game Time*", Games Magazine, May/Jun. 1978.

*Primary Examiner*—Vance Y. Hum
*Assistant Examiner*—Leo P. Picard
*Attorney, Agent, or Firm*—W. G. Fasse; D. F. Gould

[57] ABSTRACT

A timepiece having a game function preferably includes a single display having a figure displaying region and a numerical value displaying region. A game mode is established upon operation of a game start switch. The figure displaying region includes an arrangement of a plurality of figure displaying segments and a predetermined one or a certain number of segments out of the plurality of segments is selectively activated for a display responsive to an operation of a game operation switch in the game mode, whereby a figure representation on the display is changeable in response to the operation of the game operation switch. A score counter evaluates a score of the game in response to the change of the figure representation. Upon operation of the game start switch, the content in the score counter is displayed by the numerical value displaying region. Normally or in a timepiece mode, the current time information obtained from a timepiece apparatus is displayed by the numerical value displaying region; however, upon operation of the game start switch, the numerical value displaying region is switched to display the score of the game, as described above. Upon termination of the game mode, the timepiece mode is automatically regained. Upon operation of a reset switch, operation of the game operation switch enables the correction of the current time information obtained from the timepiece apparatus.

48 Claims, 16 Drawing Figures

TIMEPIECE APPARATUS HAVING A GAME FUNCTION

BACKGROUND OF THE INVENTION

1. Field of the Invention

The present invention relates to a timepiece apparatus having a game function. More specifically, the present invention relates to a novel timepiece apparatus having a game function including a display comprising a digital displaying portion for a current time display and a figure displaying portion for displaying a game when a game is played through a display of a figure for a game.

2. Description of the Prior Art

Heretofore, a timepiece apparatus having a digital display for displaying the current time information in a digital manner has been proposed and put into practical use. Such conventional digital display type timepieces may be incorporated in a clock, a wristwatch and so on; however, such conventional timepieces with a digital display were merely adapted to display the current time information such as the day of a month, the day of a week, the hour, the minute, the second and so on. Accordingly, such conventional timepieces of a digital display type fail to have other functions such as a game function.

SUMMARY OF THE INVENTION

The present invention relates to a timepiece apparatus having a game function comprising a display including a game information displaying region for displaying at least a figure or symbol for a game and a numerical value displaying region for displaying at least the current time information. Upon selection of a game mode, a game can be played using a figure or symbol displayed in the game information displaying region, whereas upon selection of a timepiece mode the current time information obtained from a timepiece apparatus is displayed in the numerical value displaying region. Thus, the present timepiece apparatus having a game function is capable of not only displaying the current time information as a timepiece but also providing a game function for playing a game. As a result, a timepiece apparatus capable of multiple performances is provided which has a versatile usefulness. The terms "symbol" and "figure" are used interchangeably herein.

In a preferred embodiment of the present invention, the numerical value displaying region is commonly used for both purposes, namely displaying the score of a game and displaying the current time information. More specifically, upon selection of a game mode, a score associated with a game being played is displayed in a digital manner in the numerical value displaying region, whereas upon selection of a timepiece mode the current time information is displayed in the numerical value displaying region. By thus implementing the display region to be commonly utilizable in both the game mode and in the timepiece mode, the circuitry for activating the display and the circuit connections such as lead wires are simplified and used efficiently. As a result, a timepiece apparatus having a game function can be implemented by a simple, inexpensive structure.

In another preferred embodiment of the present invention, a best score memory is provided for storing the best score among the scores attained by the games played in the previous game modes and the numerical value displaying region is also used to display the best score. Upon selection of the game mode, the numerical value displaying region is first activated to display the best score, whereupon the numerical value displaying region is activated to display the score of the game being presently played. Upon termination of the game, the current time information obtained from the timepiece is displayed by the numerical value displaying region.

In a further preferred embodiment of the present invention, the game figure displaying region is constructed to changeably display a figure for a game so that the figure looks as if the same is moving. The apparatus comprises an operation portion for acting upon such changeable figure for causing such change. In the game mode, a game may be played by operating the operation portion for causing such change of the figure on the display. The operation portion for playing such game can be commonly used for setting of the current time or for correcting of the current time of the timepiece. More specifically, upon selection of the timepiece mode, the hour and minute display of the timepiece may be more quickly advanced than the normal speed upon operation of the operation portion for the game, whereby the current time of the timepiece is corrected. Thus, such common utilization of the operation portion both in the game mode and the timepiece mode may be advantageously employed for achieving compactness of the apparatus. Assuming that such operation portions are separately provided for the game mode and for the timepiece mode, then a space for the operation portion is required for each mode, whereby the size of the apparatus becomes large, the number of components is increased and hence the device becomes expensive. However, by implementing the operation portion to be commonly used as in the above described embodiment, the total space for the operation portion and the cost may be reduced.

In a further preferred embodiment of the present invention, a microcomputer or a microprocessor implementing large scale integration, is used. Microcomputers for multiple performances are readily available. Thus, by implementing the present apparatus with a microcomputer which is commonly usable in the timepiece mode and the game mode, a compact and inexpensive timepiece apparatus having a game function has been provided.

In still a further preferred embodiment of the present invention, the numerical value displaying region is constructed for displaying the numerical value of four digits. Accordingly, in the timepiece mode the numerical value displaying region is adapted to display only the hour and the minute, while the same is incapable of displaying the second. Therefore, in a further preferred embodiment of the present invention, in the timepiece mode the game figure displaying region is used for displaying the second. In the case where the game figure displaying region comprises a plurality of segments, the plurality of segments are selectively activated for displaying each second in turn. Alternatively, one segment may be intermittently activated for display in a blinking manner at every second. Thus, in the timepiece mode, the current time information is more accurately displayed to the extent of the second, while the game mode operation may also be confirmed with ease.

Accordingly, it is a principal object of the present invention to provide a novel timepiece apparatus having a game function which is capable of displaying the current time information and also of providing a game function.

Another object of the present invention is to provide a novel timepiece apparatus having a game function with a simple structure and which is inexpensive.

A further object of the present invention is to provide a compact time piece apparatus having a game function.

These objects and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figure 1:
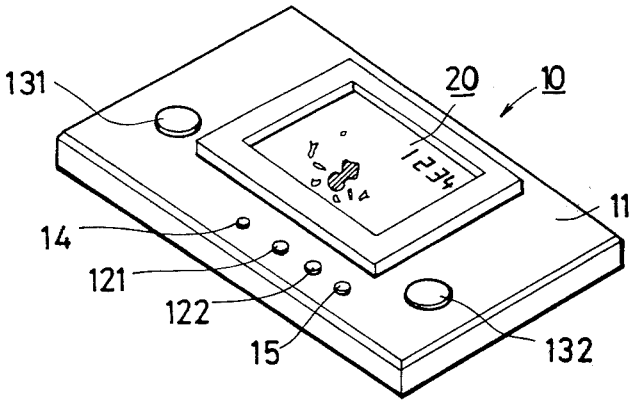
FIG. 1 is a perspective view of one embodiment of the present invention.

FIG. 1 is a perspective view showing one example of a timepiece apparatus having a game function in accordance with the present invention. Referring to FIG. 1, the present timepiece apparatus comprises a housing 11 enclosing various circuit components. A practical size of the apparatus 10 is 95 mm by 63 mm, and 12 mm thick. However, such dimensions may be arbitrarily selected. A display 20 is provided on the upper surface of the housing 11. The display 20 is preferably implemented by using liquid crystals. However, the display 20 may be a conventional display, implemented by using electroluminescence, electrochromic or the like display means. As will be more fully described below with reference to FIG. 2, the display 20 comprises a game figure displaying portion comprising a plurality of segments for displaying a figure for a game and a numerical value displaying portion of a digital display type for displaying the score of a game or the current time. Various operation switches are also provided on the housing 11 in the vicinity of the display 20 for playing a game and for setting the current time of the timepiece. The operation switches 121 and 122 are game start switches for selecting a game mode. Accordingly, upon operation of the start switch 121 or 122, the apparatus is placed in a game operation mode or a game mode. The operation switches 131 and 132 provided left and right of the display 20 are operation switches for a game. Upon operation of the switch 131 or 132, a figure for a game can be changeably displayed on the display 20. The operation switch 14 is a reset switch for setting the current time and the operation switch 15 is a timepiece mode switch for displaying the current time information in the display 20. As will be described in more detail below, the above described switches 131 and 132 are not only used for the game mode but are also commonly used for the timepiece mode.

Figure 2:
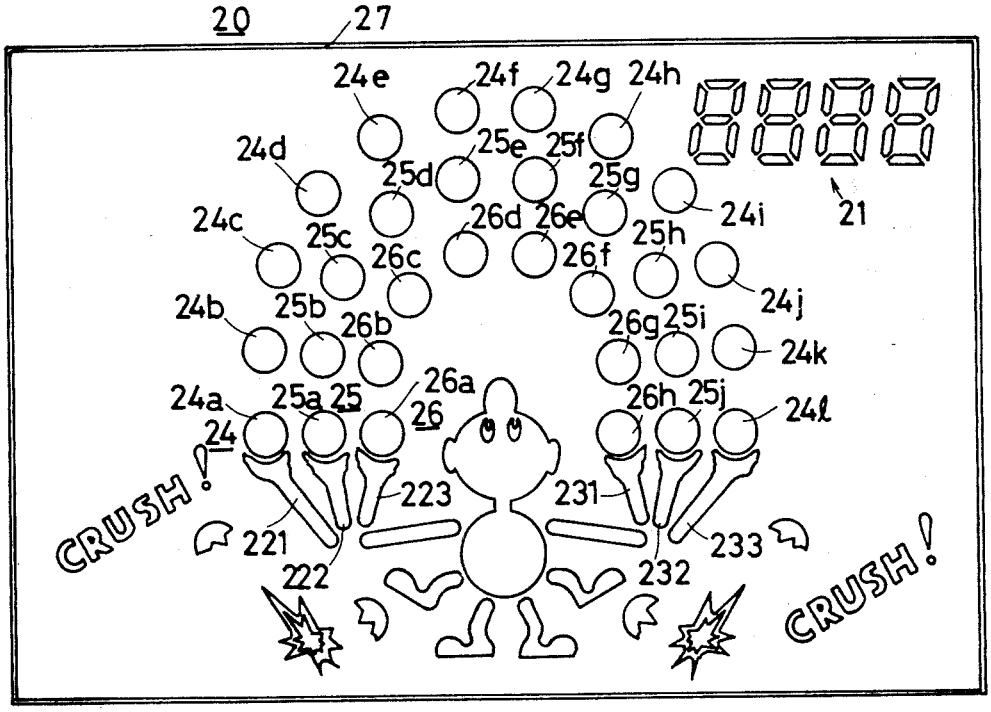
FIG. 2 is a diagrammatic view showing one example of a display.

FIG. 2 is a diagrammatic view showing one example of a display pattern of the display 20 of a first embodiment. In accordance with the first embodiment shown, the apparatus 10 is constructed for playing a ball juggling game or a ball tossing up game, for example. It is pointed out that the apparatus can be constructed to play a different kind of game, as desired, in accordance with the present invention. In accordance with the embodiment shown, the display 20 comprises a single numerical value displaying region 21 for selectively displaying the score of a game or displaying the current time. The remaining area of the display 20 constitutes a game figure displaying region for displaying a figure for a game. Since an example of a ball juggling game or a ball tossing up game is employed in the embodiment shown, three groups 24, 25 and 26 of segments are formed such that these are arranged in parallel and in an arcuate form. The outermost segment group 24 comprises twelve ball symbol segments **24*a* to 24*l*. The innermost segment group 26 comprises eight ball symbol segments 26*a* to 26*h*. The middle segment group 25 comprises ten ball symbol segments 25*a* to 25*j*. Accordingly, when one out of the respective ball symbol segments 24*a* to 24*l* of the segment group 24 is selectively and in succession activated for display, the segment group 24 looks like as if the ball symbol is moving along the segment group 24 in the display 20. The same applies to other segment groups 25 and 26. These segments constitute game object means, for example in the form of a ball. The game object means constitute apparatus controlled symbols. At both ends of each of the segment groups 24, 25 and 26, hand symbol segments 221, 222, 223 and 231, 232, 233 are formed to resemble a human hand which reaches toward the end segments 24*a*, 25*a*, 26*a* and 26*h*, 25*j*, 24*l*, respectively. These hand symbol segments may be referred to as player controlled symbols. These hand symbol segments 221 to 223 and 231 to 233 can be selectively activated for display through the operation of the operation switches 131 and 132 shown in FIG. 1, which will be more fully described below. A human shaped segment is formed between these hand symbol segments 221 to 223 and 231 to 233. Accordingly, as a whole, the segment arrangement constituting a figure for a game looks like a human playing a ball juggling game or a ball tossing up game. Other segments are also individually formed for displaying other characters and decorative symbols. The display 20 further comprises four sets of "8" letter shaped segments in the above mentioned numerical value displaying region 21. The display 20 further comprises a whole surface electrode or a common electrode 27 commonly acting on all of the above described segments such as the ball symbol segments, the hand symbol segments, the "8" letter shaped segments and so on. Accordingly, when a drive voltage is applied between the common electrode 27 and any one or several of the segments, the segment or segments are activated for a visual display. The numerical value displaying region 21** is allotted for displaying the current time information normally or in the timepiece mode.

According to the embodiment shown, the apparatus is adapted so that a game is played by counting up the score when the ball symbol segments 24a, 25a, 26a or 26h, 25j, 24l at both ends of the segment groups 24, 25, 26 and the corresponding hand symbol segments 221, 222, 223 or 231, 232, 233 are successfully activated for display at the same time on the display.

Figure 3:
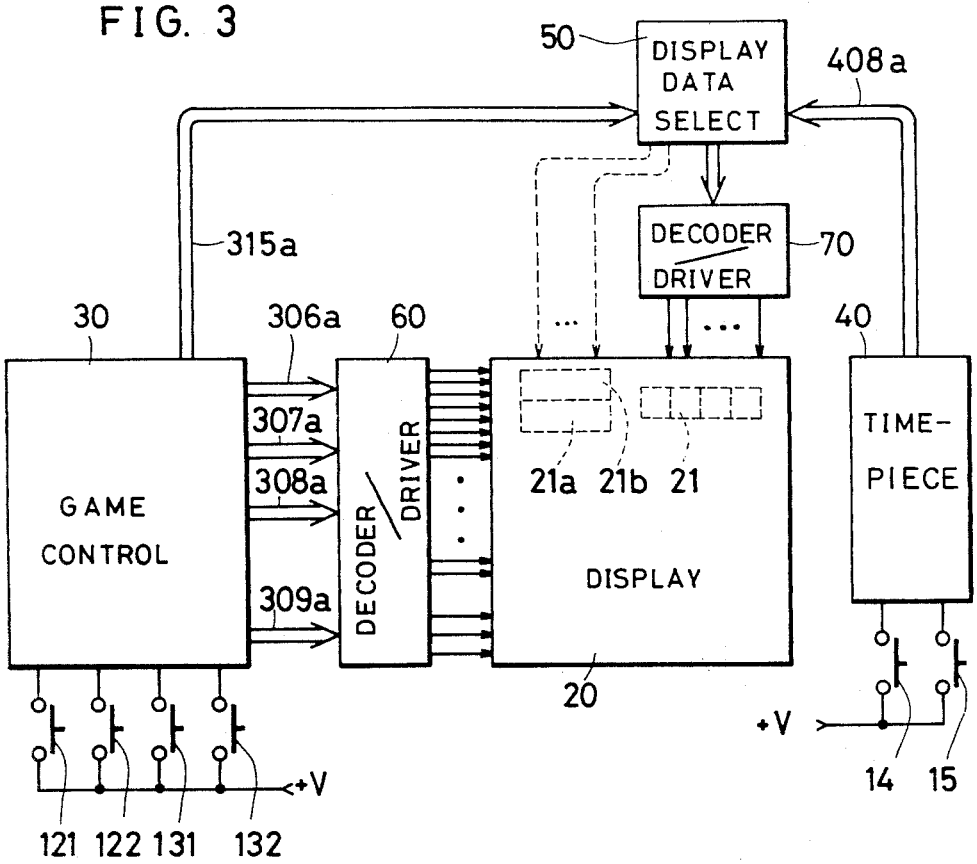
FIG. 3 is a block diagram showing the functional components of one embodiment of the present invention.

FIG. 3 is a block diagram of the functional components of a first embodiment shown.

The embodiment shown comprises a game control circuit 30, a timepiece circuit 40, and a display data selection circuit 50. The display 20 is constructed to be activated for display by means of a decoder/driver 60 for receiving a signal from a game control circuit 30 and for driving the display 20 for displaying a figure, and a decoder/driver 70 for receiving the data from the data selection circuit 50 for driving the display 20 for displaying a numerical value. The game control circuit 30 is connected to the respective switches 121, 122, 131 and 132 shown in FIG. 1 and the timepiece circuit 40 is connected to the switches 14 and 15. The operation signals of these switches are applied to the timepiece circuit 40, to the game control circuit 30 and to the display data selection circuit 50, as necessary. The game control circuit 30 is responsive to the operation states of the associated switches to provide the data for activating the segment groups 24, 25 and 26 shown in FIG. 2, to the decoder/driver 60 through data buses 306a, 307a and 308a such that the game symbols represented by these display segments exhibit simulated movements relative to each other which appear to change in a manner which is unknown to or substantially unpredictable by the player. In other words at the moment the player does not know what the relative movement change will be. The game control circuit 30 is also responsive to the operation of the switches 131 and 132 to provide the data for selecting the hand symbol segments 221 to 223 and 231 to 233 on the display 20, to the data/driver 60 through a data bus 309a. Thus, the game control circuit 30 and segment groups 24, 25 and 26 comprise means for imparting relative movements of the game objects or apparatus controlled symbols in the available paths and for changing in a manner that appears to be unpredictable to the player, the relative movements of such apparatus controlled symbols in response to predetermined positional relationships between the apparatus controlled symbols and the player controlled symbols. The game control circuit 30 also provides the score data obtained upon operation of the switches 131 and 132 by a player, to the display data selection circuit 50 through a data bus 315a. On the other hand, the timepiece circuit 40 provides the current time information to the display data selection circuit 50 through a bus 408a. The display data selection circuit 50 is responsive to the operations of the switches to provide selectively either the score data obtained from the bus 315a or the current time data from the bus 408a to the decoder/driver 70. Accordingly, the display 20 selectively displays the score data or the current time information by the numerical value display portion 21. Now the structure and the operation of these circuits will be more specifically described in the following with reference to FIGS. 4A to 4C and 5.

Figure 5:
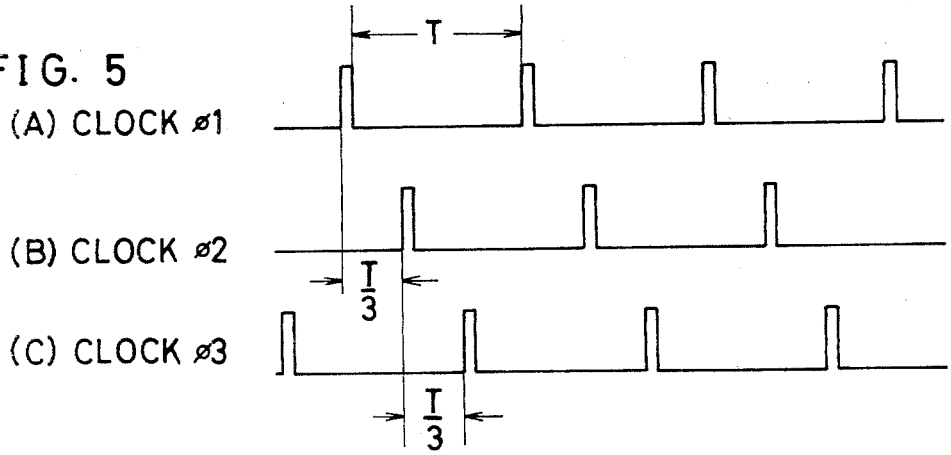
FIG. 5 is a timing chart for showing one example of clock pulses associated with FIG. 4A.
Figure 4A:
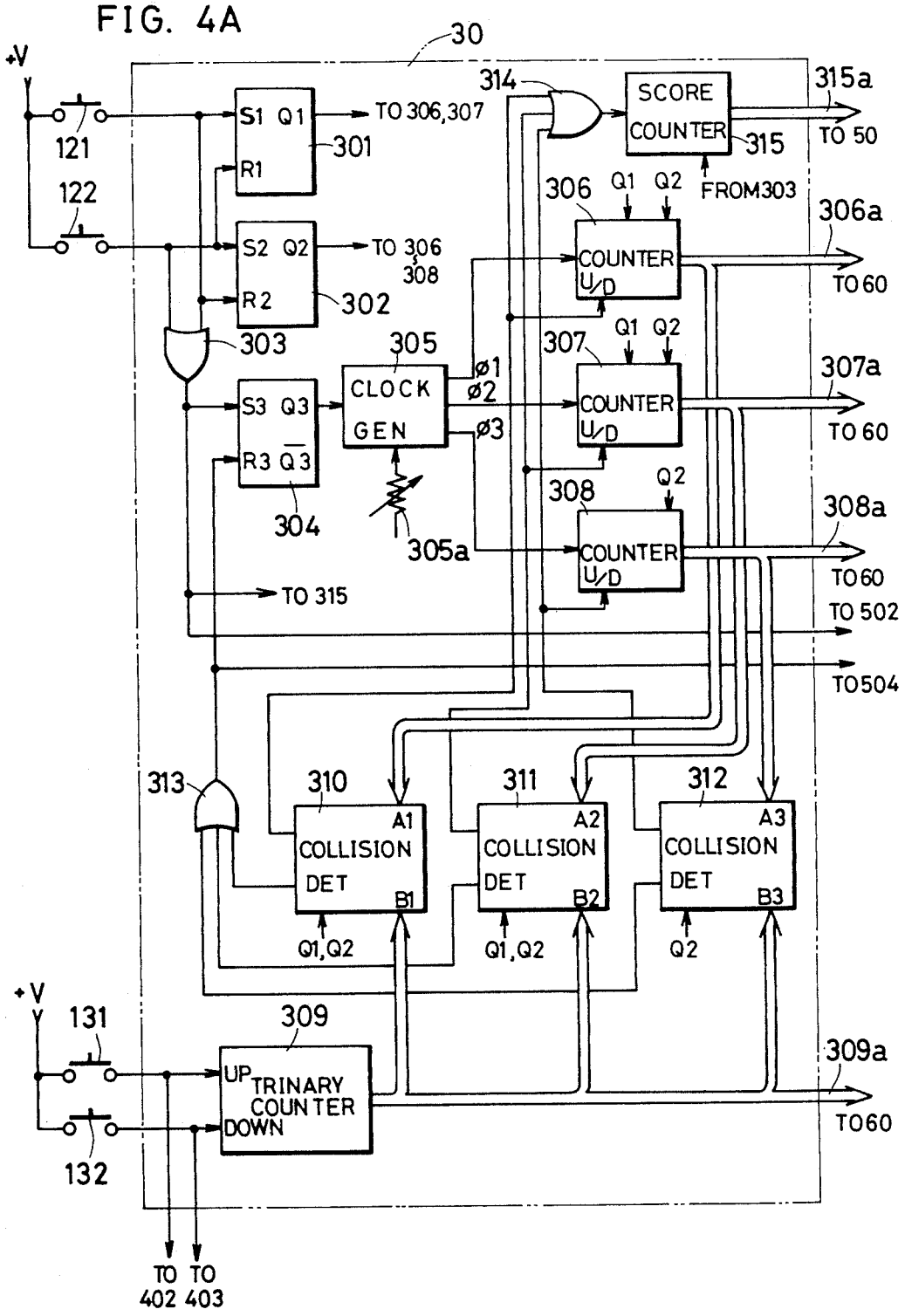
FIGS. 4A, 4B, and 4C are block diagrams showing a game control portion, a timepiece portion, and a data/-display control portion, respectively.

FIG. 4A is a block diagram of the game control circuit 30. The circuit 30 is connected to the start switches 121 and 122. The start switch 121 is to be operated when a game is played using only the segment groups 24 and 25 shown in FIG. 2, while the start switch 122 is to be operated when a game is played using all the segment groups 24, 25 and 26. The operation signal of the start switch 121 is applied to the set input S1 of a flip-flop 301 and is also applied to the reset input R2 of a flip-flop 302 and one input of an OR gate 303. The operation signal of the start switch 122 is applied to the set input S2 of the flip-flop 302 and to the reset input R1 of the flip-flop 301 and the other input of the OR gate 303. Accordingly, the flip-flop 301 serves to store the information indicating that the start switch 121 is operated, i.e. the game being played using only two segment groups 24 and 25 is started, while the flip-flop 302 stores the information indicating that the start switch 122 is operated, i.e. the game being played using all the segment groups 24, 25 and 26 is started. The OR gate 303 provides the output when either the start switch 121 or 122 is operated, i.e. the game is started or the apparatus is placed in the game mode and the output of the OR gate 303 is applied to the set input S3 of a flip-flop 304 and is also applied to the reset input of a score counter 315 to be described below and is also applied to the display data selection circuit 50, as will also be described below. More specifically, the flip-flop 304 stores the information indicating that either game mode is established, thereby to provide the output Q3, which is applied to a clock generator 305 to enable the same. The clock generator 305 generates clock pulses Ø1, Ø2 and Ø3 for the segment group 24, 25 and 26, respectively. The clock pulses Ø1, Ø2 and Ø3 obtained from the clock generator 305 are shown in FIG. 5. The clock pulses Ø1, Ø2 and Ø3 are generated to have the same period T and the phases shifted by $\frac{1}{3}$T from each other. Since the number of segments in each group 24, 25, 26 is different and since the number of steps from segment to segment in each group is different, driving these segments in response to phase shifted clock pulses having the same time period creates movements which are substantially unknown to or substantially unpredictable for the player. The clock pulse Ø1 is applied to the count input of a counter 306 to serve as a clock pulse for selectively and in succession activating the ball symbol segments 24a to 24l included in the segment group 24 shown in FIG. 2. The clock pulse Ø2 is applied to the count input of the counter 307 to serve as a clock pulse for selectively and in succession activating the ball symbol segments 25a to 25j in the segment group 25. Similarly, the clock pulse Ø3 is applied to the count input of a counter 308 to serve as a clock pulse for selectively and in turn activating the ball symbol segments 26a to 26h of the segment group 26. Each of the counters 306 to 308 is a 16-nary reversible counter. The counters 306 and 307 are allotted for the segment group 24 and 25, respectively and accordingly are set to be responsive to any one of the outputs Q1 of the flip-flop 301 and Q2 of the flip-flop 302. On the other hand, the counter 308 is allotted to the segment group 24 and is set to be responsive to only the output of the flip-flop 302. After the counter 306 is set, the same makes an up count operation or a down count operation responsive to each clock pulse Ø1. Similarly, the counter 307 is responsive to each clock pulse Ø2 to make an up count operation or a down count operation in succession. The counter 308 is responsive to each clock pulse Ø3 to make an up count operation or a down count operation in succession. The count values in these counters 306 to 308 are applied to the decoder/driver 60 through the buses 306a to 308a and are also applied to the inputs A1 to A3 of the corresponding collision detecting circuits 310 to 312. The collision detecting circuit 310 is provided for detecting an apparent collision between the ball symbol segment 24*a* and the hand symbol segment 221 and an apparent collision between the ball symbol segment 241 and the hand symbol segment 233 of the display 20. The collision detecting circuit 311 is aimed to detect an apparent collision between the ball symbol segment 25*a* and the hand symbol segment 222 and an apparent collision between the ball symbol segment 25*j* and the hand symbol segment 232 on the display 20. The collision detecting circuit 312 is aimed to detect an apparent collision between the ball symbol segment 26*a* and the hand symbol segment 223 and an apparent collision between the ball symbol segment 26*h* and the hand symbol segment 231. These collision detecting circuits 310 to 312 are connected to receive at the other inputs B1 to B3, respectively, the count value of the trinary counter 309.

The game control circuit 30 is also connected to the operation switches 131 and 132. The operation switch 131 is used to displace the position of the activated hand symbol segment leftward, as viewed in FIG. 2 with respect to the hand symbol segments 221 to 223 and 231 to 233. The operation switch 132 is used to displace the activated hand symbol segment in the opposite direction with respect to these hand symbol segments 221 to 223 and 231 to 233. Manual activation of switches 131, 132 imparts player controlled movements to the hand symbol segments to 221 to 223 and to 231 to 233. Accordingly, the output of the operation switch 131 is applied to the down count input of the trinary reversible counter 309. The output of the other operation switch 132 is applied to the up count input of the trinary reversible counter 309. These operation switches 131 and 132 are also applied to the timepiece circuit 40. The count value in the trinary reversible counter 309 is applied to the inputs B1, B2 and B3 of the above described collision detecting circuits 310, 311 and 312, respectively. This count value is also applied to the decoder/driver 60 (FIG. 3). The collision detecting circuit 310 determines an apparent collision between the ball symbol segment 24*a* and the hand symbol segment 221 and an apparent collision between the ball symbol segment 241 and the hand symbol segment 233. Accordingly, the input A1 of the collision detecting circuit 310 is connected to receive the count value "0" and "11" of the counter 306 and the other input B1 of the collision detecting circuit 310 is connected to receive the count value "0", "1" or "2" of the trinary counter 309. The collision detecting circuit 310 is so constructed that a coincidence output is provided if and when the input A1 is "0" and the input B1 is "0" or if and when the input A1 is "11" and the input B1 is "2". The collision detecting circuit 311 determines an apparent collision between the ball symbol segment 25*a* and the hand symbol segment 222 and an apparent collision between the ball symbol segment 25*j* and the hand symbol segment 232 on the display 20. To that end, the input A2 of the collision detecting circuit 311 is supplied with the count values "0" and "9" in the counter 307. The input B2 of the collision detecting circuit 311 is supplied with the count value "0", "1" or "2" in the trinary counter 309. Thus, the collision detecting circuit 311 is constructed so that a coincidence output is provided if and when the input A2 is "0" and the input B2 is "1" or if and when the input A2 is "9" and the input B2 is "1". Furthermore the collision detecting circuit 312 determines an apparent collision between the ball symbol segment 26*a* and the hand symbol segment 223 and an apparent collision between the ball symbol segment 26*h* and the hand symbol segment 231 on the display 20. Accordingly, the input A3 of the collision detecting circuit 312 is supplied with the count value "0" and "7" of the counter 308. The input B3 of the collision detecting circuit 312 is supplied with the count value "0", "1" or "2" in the trinary counter 309. The collision detecting circuit 312 is constructed so that the coincidence output is provided if and when the input A3 is "0" and the input B3 is "2" or if and when the input A3 is "7" and the input B3 is "0".

Conversely, the collision detecting circuit 310 provides a non-coincidence output if and when the input B1 is not "0" while the input A1 is "0", or if and when the input B1 is not "2" while the input A1 is "11". Similarly, the collision detecting circuit 311 provides a non-coincidence output if and when the input B2 is not "1" while the input A2 is "0", or if and when the input B2 is not "1" while the input A2 is "9". Furthermore, the collision detecting circuit 312 provides a non-coincidence output if and when the input B3 is not "2" while the input A3 is "0", or if and when the input B3 is not "0" while the input A3 is "7". The coincidence signals of these collision detecting circuits 310, 311 and 312, respectively, are applied through an OR gate 314 to the score counter 315 and are also applied to the corresponding counters 306, 307 and 308, respectively, as count mode (U/D) switching signals. More specifically, upon receipt of the corresponding coincidence signals, the counters 306, 307 and 308 change the respective counting modes from the up count mode to the down count mode or from the down count mode to the up count mode. This means that on the display 20 (FIG. 2) after the ball symbol segment 24*a* and the hand symbol segment 221 are simultaneously activated the ball symbol segments are selectively activated one by one in succession in the order of 24*b*, 24*c*, . . . , 24*l*, hereupon after the ball symbol segment 24*l* and the hand symbol segment 233 are simultaneously activated the ball symbol segments are selectively activated in succession one by one in the order of 24*l*, 24*k*, . . . , 24*a*, and so on. The same applies to the other segment groups 25 and 26. Accordingly, on the display 20, when the ball symbol segment is successfully received by the corresponding hand symbol segment, the successful reception is detected, whereupon the score counter 315 is advanced and the apparent moving direction of the moving symbol segment is reversed. Furthermore, on the display 20, when the ball symbol segment is not successfully received by the corresponding hand symbol segment, the non-coincidence outputs are obtained from the collision detecting circuits 310, 311 and 312 and the non-coincidence outputs are applied through the OR gate 313 to the reset input R3 of the flip-flop 304 and are also applied to the data selection circuit 50. More specifically, upon detection of a non-coincidence by any of the collision detecting circuits 310, 311 and 312, the flip-flop 304 is reset, thereby to terminate the game mode. Further, due to the above-mentioned available counting states of the counter 306, 307 and 308, and the different (non-equal) numbers of symbol segments and segment groups 24, 25 and 26, each time the direction of a moving ball symbol is reversed in one of the groups, or the play mode is terminated due to a missed juggle, the detected predetermined positional relationship between the ball symbol segments and the hand symbol segments (collision and non-collision detections), the subsequent relative movements of the ball symbols in the various segment groups change in a fashion that appears to be unknown or unpredictable to the player, to a different sequence of relative movements that also appear to be unknown or unpredictable to the player.

Figure 4B:
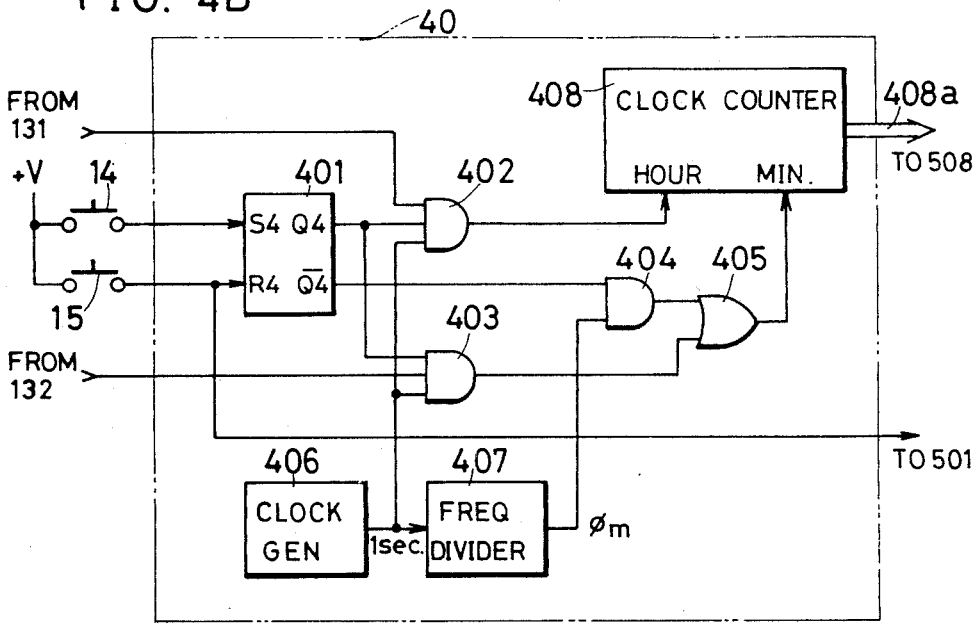

FIG. 4B is a block diagram of the timepiece circuit 40. The timepiece circuit 40 is connected to the reset switch 14 and the timepiece mode switch 15. The operation signal of the reset switch 14 is applied to the set input S4 of a flip-flop 401 and the operation signal of the timepiece mode switch 15 is applied to the reset input R4 of the flip-flop 401 and is also applied to the display data selection circuit 50. The output Q4 of the flip-flop 401 is applied to the respective inputs of AND gates 402 and 403. Another input of the AND gate 402 is connected to receive the operation signal of the above described game operation switch 131 and another input of the AND gate 403 is connected to receive the operation signal of the game operation switch 132. The timepiece circuit 40 comprises a clock generator 406 for generating a fundamental clock signal serving as a reference clock signal for a counting operation for obtaining the current time information. The fundamental clock generator 406 comprises a quartz resonator having a resonance frequency of 32,768 Hz, for example, and a frequency divider for dividing the frequency output of the quartz resonator. The clock generator 406 provides a clock pulse for each second which is applied to the remaining inputs of the above described AND gates 402 and 403 and is also applied to the frequency divider 407 including a counter. The frequency divider 407 provides a minute clock pulse Øm for each minute. The minute clock Øm obtained from the frequency divider 407 and the output Q4 from the flip-flop 401 are applied to an AND gate 404. The output of the AND gate 404 is applied through an OR gate 405 to the "minute" input of the clock counter 408. Accordingly, the clock counter 408 advances one step for each output from the OR gate 405, i.e. for each minute clock pulse Øm obtained from the frequency divider 407, after the operation of the timepiece mode switch 15 until the operation of the reset switch 14, i.e. during the time period when the output Q4 of the flip-flop 401 is at the high level, whereby the current time is measured. The content in the clock counter 408 is applied through the bus 408*a* to the display data selection circuit 50 as current time information data.

Upon operation of the switch 14, the flip-flop 401 is set and the output Q4 thereof becomes the high level and the output Q4 becomes the low level. Accordingly, the AND gate 404 is closed and the "minute" input of the clock counter 408 is not supplied with the minute clock pulse Øm from the frequency divider 407. The AND gates 402 and 403 are enabled in response to the output Q4 of the flip-flop 401. When the game operation switch 131 is operated at that time, the clock signal is obtained from the AND gate 402 for each second clock pulse from the clock generator 406 and the same is applied to the "hour" input of the clock counter 408. On the other hand, when the game operation switch 132 is operated at that time, the clock pulse is obtained from the AND gate 403 for each second clock pulse from the clock generator 406 and the same is applied through the OR gate 405 to the "minute" input of the clock counter 408. More specifically, after the reset switch 14 is operated, the "hour" data in the clock counter 408 is renewed for each operation of the operation switch 131, while the "minute" data in the clock counter 408 is renewed for each operation of the operation switch 132. Thus, after operation of the reset switch 14, the content in the clock counter 408 is quickly advanced in response to the operation of the switches 131 and 132, whereby the current time can be adjusted or set.

Figure 4C:
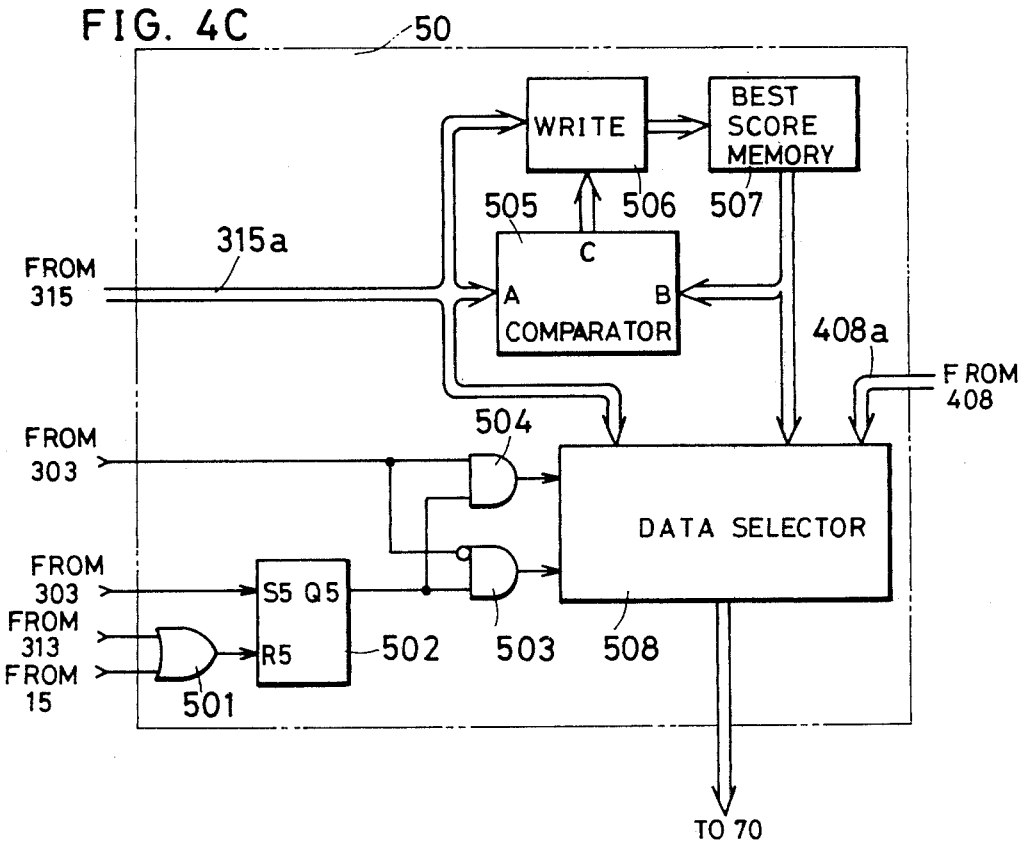

FIG. 4C is a block diagram showing the display data selection circuit 50 which is supplied with the score data from the score counter 315 through the data bus 315*a*. At the same time, the display data selection circuit 50 is supplied with the current time data from the clock counter 408 through the data bus 408*a*. The score data is applied to one input A of a comparator 505 and is also applied to a write circuit 506 and the data selector 508. the current time data is also applied to the data selector 508. The data selector 508 is also supplied with the best score data from a best score memory 507 which has stored the best score among the scores attained by a player in the previous game mode. The output of the best score memory 507 is applied to the other input B of the comparator 505. The comparator 505 compares the inputs A and B, to provide the data which is larger to the write circuit 506. Accordingly, if the current score data A is larger than the best score data B so far attained, the score attained at that time is stored in the best score memory 507 as the new best score. Otherwise, the best score so far attained is restored in a memory 507. The data selector 508 is responsive to the outputs of the AND gates 503 and 504 to selectively switch the score data thus attained in the current game, the best score data so far attained, and the current time data, and the selected data are applied to the decoder/driver 70 for display of the corresponding numerical value.

The output from the OR gate 313 in FIG. 4A, i.e. the non-coincidence output obtained when the ball symbol segment is not successfully received by the hand symbol segment on the display shown in FIG. 2, and the operation signal of the timepiece mode switch 15 are applied through an OR gate 501 to the reset input R5 of a flip-flop 502. The set input S5 of the flip-flop 502 is supplied with the output from the OR gate 303 shown in FIG. 4A, i.e. the operation signals of the start switches 121 and 122. Accordingly, the flip-flop 502 stores whether the apparatus is in the game mode or in the timepiece mode. When the output Q5 of the flip-flop 502 is at the high level, this means that the current mode of the apparatus is the game mode. The output Q5 of the flip-flop 502 is applied to one input of each of the AND gates 503 and 504. The other input of the AND gate 503 is connected to receive the output from the OR gate 303 shown in FIG. 4A, after inversion, and the other input of the AND gate 504 is connected to receive the output of the OR gate 303. The data selector 508 is responsive to the outputs of these AND gates 503 and 504, thereby to select one among the above described data inputs. Accordingly, if and when the apparatus is in the game mode and in the absence of the output from the OR gate 313, i.e. when the game is continuing, the output from the AND gate 503 is at the high level. The AND gate 504 provides a high level output, when the apparatus is in the game mode and in the presence of the output from the OR gate 313, i.e. when a player fails in receiving the ball symbol segment with the corresponding hand symbol segment. The data selector 508 is responsive to the low level outputs of both AND gates 503 and 504, i.e. the non-game mode, to select the current time data from the data bus 408*a*. Furthermore, the data selector 508 is responsive to the high level output of the AND gate 503 and to the low level output of the AND gate 504 to select the score data from the data bus 315*a*, whereas the data selector 508 is responsive to the high level output only from the AND gate 504 to select the best score data from the best score memory 507.

The operation of the above described embodiment will be described with reference to FIGS. 1 to 5. At the outset, a game will be described which is being played using two segment groups 24 and 25 on the display 20. However, at least two kinds of games are possible. In such a case, a player first depresses one start switch 121. Then, the flip-flop 301 is set and the other flip-flop 302 is reset. At the same time, the operation signal of the start switch 121 is applied through the OR gate 303 to set the flip-flop 304 and to also set the flip-flop 502. When the output Q1 of the flip-flop 301 assumes the high level, the counters 306 and 307 are enabled and, when the output Q3 of the flip-flop 304 becomes the high level, the clock generator 305 is enabled. At the same time the flip-flop 502 is set.

During the operation of the start switch 121, the high level output is continually obtained from the OR gate 303 and only the output of the AND gate 504 is at the high level during that period. Accordingly, the data selector 508 continually provides to the decoder/driver 70 the best score data stored in the best score memory 507 during the period of operation of the start switch 121. Therefore, the numerical value displaying region 21 of the display 20 displays during the period of operation of the start switch 121 the best score attained in the previous game. When the operation of the start switch 121 is released, the output of the AND gate 504 assumes the low level and the output of the AND gate 503 assumes the high level. Therefore, the data selector 508 thereafter provides the score data from the bus 315*a* to the decoder/driver 70.

When the clock generator 305 is thus enabled, the clocks Ø1, Ø2 and Ø3 as shown in FIG. 5 are generated from the clock generator 305. However, since the counter 308 has not been set, only the counters 306 and 307 are responsive to the two clocks Ø1 and Ø2 to make a counting operation. Accordingly, the count values in the counters 306 and 307 are applied through the buses 306*a* and 307*a* to the decoder/driver 60, whereby the respective ball symbol segments 24*a* to 24*l* and 25*a* to 25*j* of the segment groups 24 and 25 on the display 20 are selectively and in turn activated for display.

The player must actuate the operation switch 131 or 132 to select the hand symbol segment 221, 222, 232 or 233 on the display 20 for successfully receiving the ball symbol segments with the corresponding hand symbol segments. More specifically, when the switch 131 is operated, the trinary reversible counter 309 counts down one step. Accordingly, the display is changed so that the hand symbol segments being activated for display are changed from the hand symbol segment 233 and 222 to the hand symbol segments 232 and 221 upon operation of the switch 131. Upon operation of the switch 132, the trinary reversible counter 309 counts one step up, whereby the hand symbol segments being activated on the display 20 are displaced in the opposite direction. Since the collision detecting circuits 310 and 311 have been supplied with the output Q1 of the flip-flop 301 and have been enabled, the coincidence output is obtained from these collision detecting circuits 310 and 311, insofar as the player successfully receives the ball symbol segments with the corresponding hand symbol segments on the display 20, whereby the score counter 315 is stepped or advanced in response to each coincidence output. Since the data selector 508 provides the score data from the data bus 315*a* to the decoder/driver 70, the score is displayed in the numerical value displaying region 21 of the display 20.

Conversely, if and when the player fails in receiving the ball symbol segments with the corresponding hand symbol segments on the display 20 through failure in the proper operation of the switch 131 or 132, a non-coincidence output is obtained from the collision detecting circuit 310 or 311. The non-coincidence output is applied through the OR gates 313 and 501 to the reset input R5 of the flip-flop 502. Accordingly, the flip-flop 502 is reset and the output Q5 thereof turns to the low level. Therefore, the game mode is terminated and the outputs of the AND gates 503 and 504 all assume the low level. Therefore, the data selector 508 selects the current time data from the bus 408*a* and provides the same to the decoder/driver 70 whereby the numerical value displaying region 21 of the display 20 will display the current time information instead of the score information upon termination of the game mode. In changing the operation mode from the game mode to the timepiece mode through failure in the game mode, the apparatus may be adapted so that the operation may be changed after the lapse of a predetermined period of time upon determination of such failure in the game mode. Alternatively, the apparatus may be adapted so that the operation mode may be changed from the game mode to the timepiece mode based on not only one failure but rather based on a predetermined number of failures, say three failures.

In order to play a game using all the three segment groups 24, 25 and 26 on the display 20, the start switch 122 must be operated and not the start switch 121. Then the flip-flop 301 is reset and the flip-flop 302 is set. Accordingly, all of the three counters 306, 307 and 308 are set and all of the three collision detecting circuits 310, 311 and 312 are enabled. In substantially the same manner as described above, the ball symbol segments 24*a* to 24*l*, 25*a* to 25*j*, and 26*a* to 26*h* are selectively and in turn activated for display in response to the contents in the counters 306, 307 and 308. The player continues a game by causing the corresponding hand symbol segments to be activated through operation of the operation switch 131 or 132 when the ball symbol segments are at the ends of the segment groups. When the ball symbol segments are successfully received by the corresponding hand symbol segments, the score is advanced, while failure in receiving the ball symbol segments results in termination of the game mode.

The timepiece mode of the apparatus will now be described. In the timepiece mode the current time information is displayed in the numerical value displaying region 21 of the display 20. In such a case, the flip-flop 502 included in the display data selection circuit 50 is reset in response to either the signal obtained from the OR gate 313 of the above described game control circuit 30 or the output from the timepiece mode switch 15 to be described in detail below. Accordingly, the outputs of the AND gates 503 and 504 both assume the low level and the data selector 508 selects the current time data from the clock counter 408 through the data bus 408*a*. The timepiece circuit 40 has been continually making a time measuring operation by the clock counter 408 even during the above described game mode, as described previously. Accordingly, when the data selector 508 selects the current time information, the same is applied to the decoder/driver 70 and as a result the current time information is displayed in the numerical value displaying region 21 (FIG. 2).

Now the operation for setting or correcting of the current time of the timepiece circuit 40 will be described. When it is required to set or adjust the current time, an operator depresses the reset switch 14 whereby the flip-flop 401 is set and the output Q4 assumes the high level while the output Q4 assumes the low level. Therefore, the time measurement operation by the clock counter 408 is stopped in response to the minute clock pulse Øm from the frequency divider 407. In adjusting the digit of the "hour" of the clock counter 408, the operator depresses the game operation switch 131. Then the second clock pulse from the clock generator 408 is applied through the AND gate 402 to the "hour" input of the clock counter 408. Accordingly, the "hour" digit of the clock counter 408 is advanced by the number of second clock pulses fed through the AND gate 402 during the period of operation of the switch 131. In adjusting the digit of the "minute" of the clock counter 408, the game operation switch 132 is operated. Accordingly, the second clock pulses are obtained from the clock generator 406 through the AND gate 403. The second clock pulses are applied through the OR gate 405 to the "minute" input of the clock counter 408. Accordingly, the digit of the "minute" of the clock counter 408 is quickly advanced in response to the second clock pulses fed during the period of operation of the switch 132. At that time, the display data selection circuit 50 has selected the timepiece mode of operation. Accordingly, the manner of the above described quick advancement of the clock counter 408 can be confirmed by the numerical value displaying region 21 and the operator stops operating the switch 131 and/or 132 when a desired "hour" and/or "minute" value is reached.

After the data in the clock counter 408 is adjusted, the timepiece mode switch 15 is operated. Accordingly, the flip-flop 401 is reset and the output Q4 assumes the high level while the output $\overline{Q4}$ assumes the low level. Therefore, the clock counter 408 again measures time in response to the minute clock pulses Øm obtained from the frequency divider 407 through the AND gate 404 and the OR gate 405.

As described in the foregoing, according to the embodiment shown, the score attained by playing a game or the current time information is selectively displayed in the numerical value displaying region 21. As a result, the present apparatus can be used as both a timepiece apparatus and a game apparatus whereby the utility of the apparatus is increased. Since a single numerical value displaying region is commonly used for the score associated information (the current score and the best score) and the current time information, a single decoder may be used for that purpose and the electrode pattern of the display 20 such as a liquid crystal display can be simplified in its structure, while the number of terminals can be considerably decreased, with the result that the present apparatus can be fabricated at low cost. Furthermore, since the embodiment shown uses some operation switches for the purpose of both a game control and a current time adjustment, the structure can be further simplified.

Although in the foregoing description an example of a timepiece apparatus having a game function was described by taking an example of a ball juggling game or a ball tossing up game as an example of the game, the kind of game may be modified to play a different game using a different changeable figure display.

In the foregoing an embodiment has been described which uses a hardware circuit configuration. However, it is pointed out that the inventive concept can be implemented not only by a hardware circuit configuration but also by a software processing using a microprocessor, for example. Therefore, in the following further text an embodiment of the present invention employing a software processing using a microprocessor will be described.

Figure 6:
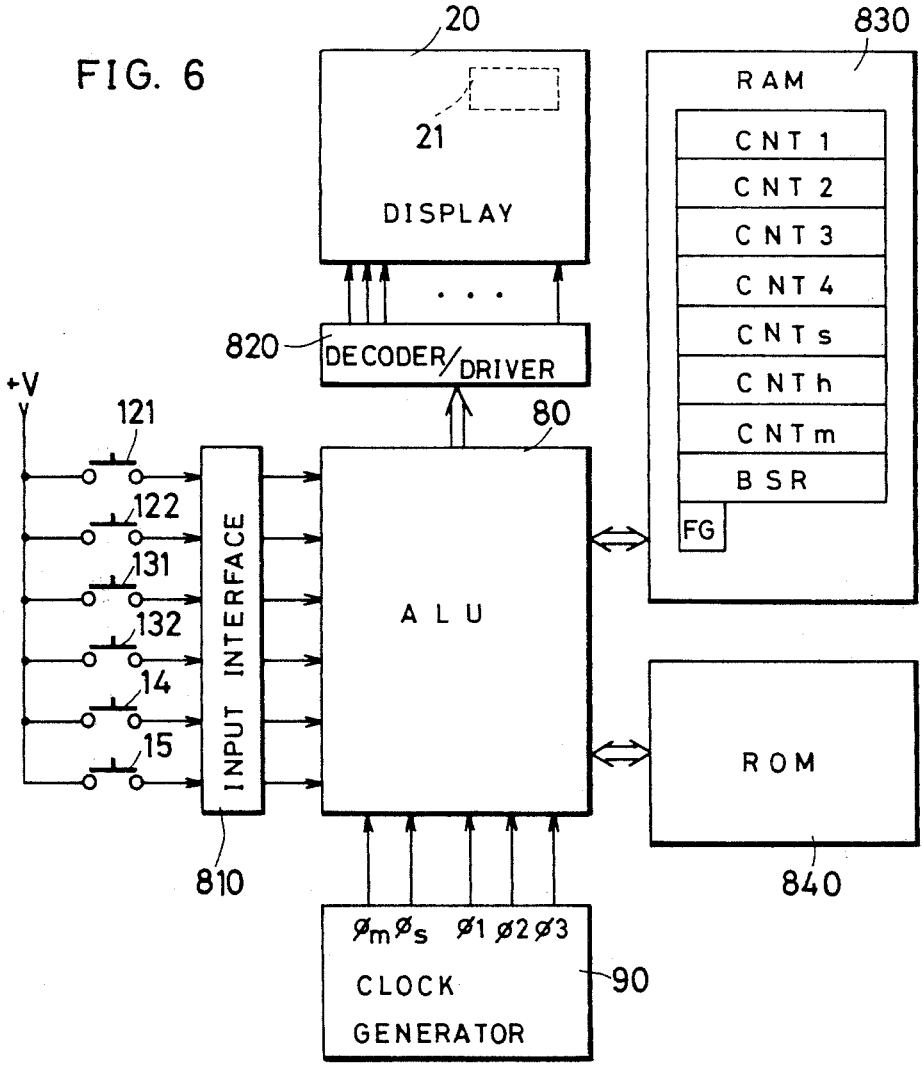
FIG. 6 is a block diagram of the functional components of another embodiment of the present invention.

FIG. 6 is a block diagram showing another embodiment of the present invention employing a microprocessor or a microcomputer for the purpose of performing the control corresponding to the operation performed by the previous embodiment shown in FIGS. 4A to 4C. Referring to FIG. 6, the operation signals obtained from the respective switches 121, 122, 131, 132, 14 and 15 are applied to an arithmetic logical unit 80 through an input interface 810. The arithmetic logical unit 80 comprises a random access memory 830 and a read only memory 840. The random access memory 830 has various storing regions and flag regions. Counter regions CNT1, CNT2, CNT3, and CNT4 included in the random access memory 830 correspond to the counters 306, 307, 308 and 309, respectively, depicted previously in conjunction with FIG. 4A.

A counter region CNTs corresponds to the score counter 315. Counter regions CNTh and CNTm cooperate with each other to perform a function corresponding to that of the clock counter 408, wherein the counter region CNTh represents an "hour" digit and the counter region CNTm represents a "minute" digit. The region BSR functions as the best score register corresponding to the best score memory 507 shown in FIG. 4C. A flag region FG is set or reset to identify the two kinds of games, i.e. the game being played using the segment groups 24 and 25 on the display 20 shown in FIG. 2 and the game being played using the segment groups 24, 25 and 26 on the display 20 in FIG. 2. The read only memory 840 stores a predetermined program such as a flow diagram shown in FIGS. 7 to 10B, to be described below.

The arithmetic logical unit 80 comprises a clock generator 90, which provides a clock pulse Øm corresponding to the minute pulse obtained from the clock generator 407 in the above described timepiece circuit 40 and which also provides the clock pulses Ø1, Ø2 and Ø3 corresponding to those obtained from the clock generator 305 included in the above described game control circuit 30. These clock pulses Øm, Ø1, Ø2 and Ø3 are applied to the arithmetic logical unit 80. The display information obtained from the arithmetic logical unit 80 is applied through a decoder/driver 820 to a display 20. The display 20 may be the same as that shown in FIG. 2.

Figure 7:
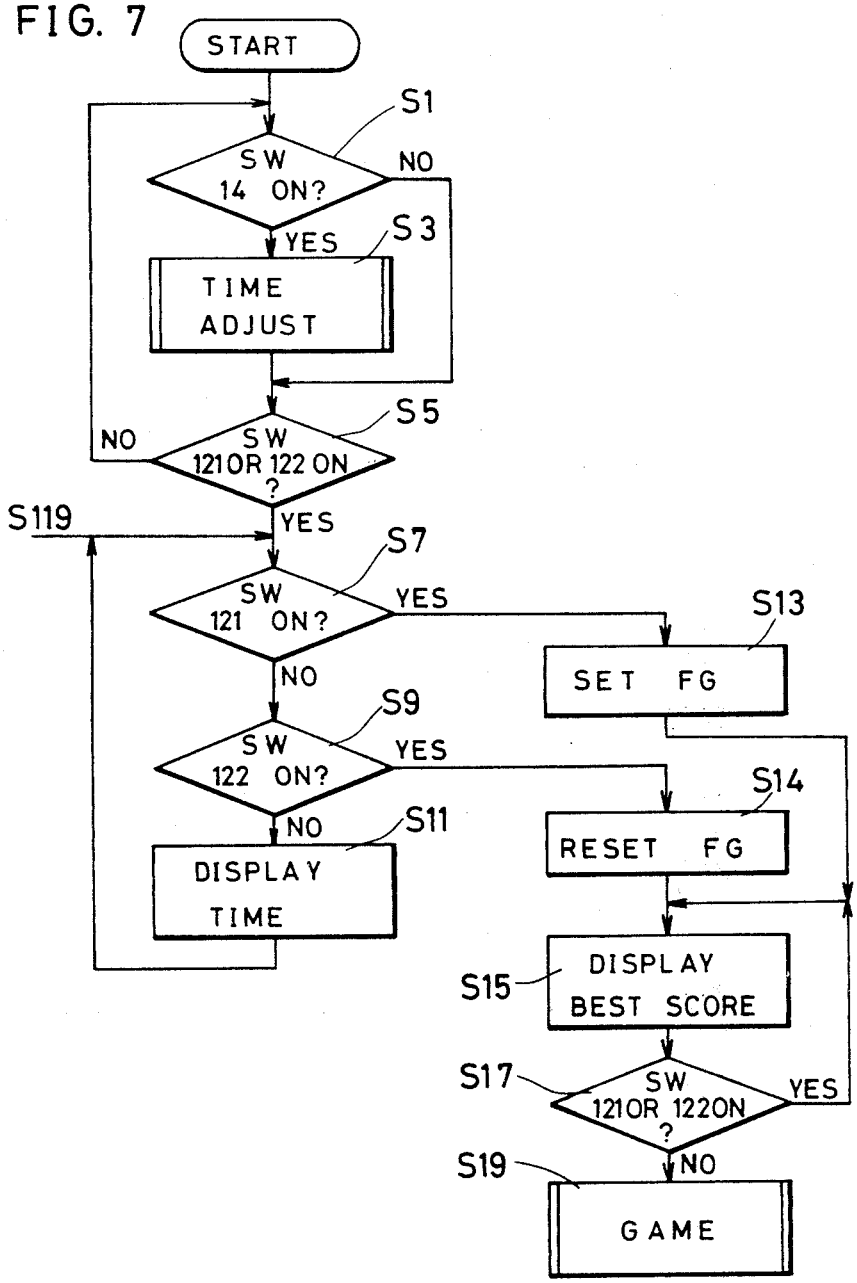
FIGS. 7, 8, 9, 10A, 10B and 11 are flow diagrams for illustrating the operation of the embodiment of FIG. 6.
Figure 8:
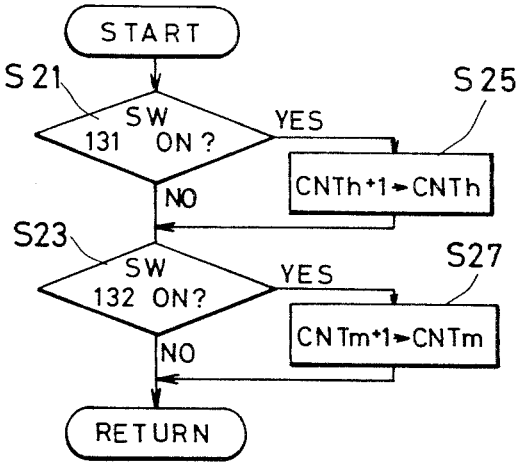

Referring to FIG. 7, the overall system operation of the embodiment of FIG. 6 will be described. Normally the apparatus is placed in a standby state and at the outset it is determined by step S1 whether the reset switch 14 is turned on. More specifically, the fact that the reset switch 14 is turned on means that a current time adjustment is required, as described above. Therefore, the program enters at step S3 into a current time adjustment subroutine shown in FIG. 8. The current time adjustment subroutine will be described below. Unless the reset switch 14 is operated, the program proceeds to the step S5, which determines whether the start switch 121 or 122 is turned on. More specifically, it is determined whether or not the initiation of a game mode is commanded. In other words, the apparatus normally determines which of the switches 121 or 122 is turned on. If and when the start switch 121 or 122 is turned on, the program proceeds to the subsequent step S7 which determines whether the operated start switch is the start switch 121. If it is determined that the start switch 121 is operated, then this means that the game being played using the segment group 24 and 25 on the display 20 is selected and the flag region FG of the random access memory 830 is set at the step S13. On the contrary, if and when it is determined at the step S9 that the start switch 122 is turned on, this means that the game being played using the three segment groups 24, 25 and 26 on the display 20 is selected and the flag region FG of the random access memory 830 is reset at the step S14. If and when no start switch has been actually operated at the steps S7 and S9, then the current time display is continued and the program returns to the previous step S7 at the step S11. If and when the flag region FG is set or reset, at the step S15 the arithmetic logical unit 80 first reads the best score data in the register region BSR in the random access memory 830 to display the same in the numerical value displaying region 21 of the display 20 through the decoder/driver 820. At the following step S17, it is again determined whether the start switch 121 or 122 is operated and, unless the start switch is operated, the program enters at the following step S19 into a game routine. The game routine will be described in more detail below with reference to FIGS. 10A and 10B. FIG. 8 shows a current time adjustment subroutine shown at the step S3 in FIG. 7. Basically, the current time adjustment subroutine is the same as the operation described above in conjunction with the hardware embodiment and the counter region CNTh of the random access memory 830 is advanced each time the game operation switch 131 is turned on, while the counter region CNTm of the random access memory 830 is advanced each time the game operation switch 132 is operated at the steps S21 to S27.

Figure 9:
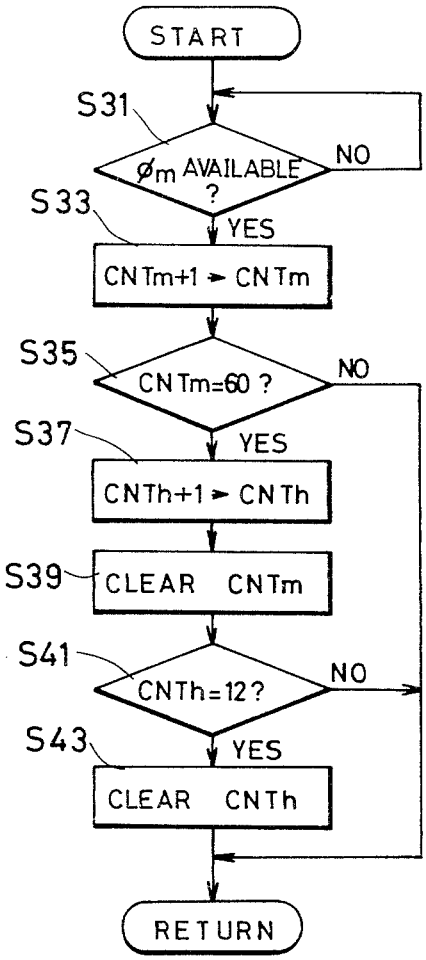

FIG. 9 is a flow diagram showing a timepiece routine, although the same was not shown in the FIG. 7 flow diagram. The timepiece routine is initiated upon application of the minute clock pulse Øm from the clock generator 90 and any other operation routines are executed until receipt of the minute clock pulse Øm at the step S31. When the minute clock pulse Øm is received, the counter region CNTm of the random access memory 830 is advanced at the step S33. At the following step S35, it is determined whether the content in the counter region CNTm has reached the value "60". More specifically, it is determined whether a period of 60 minutes has been counted by the counter region CNTm. If the period of 60 minutes has lapsed, then at the following step S37 the counter region CNTh of the random access memory is advanced. More specifically, one hour is gained. At the same time, the above described counter region CNTm is cleared at the step S39. Then at the step S41 it is determined whether the content in the counter region CNTh has reached the value "12". More specifically, since the timepiece is constructed to display the maximum of twelve hours rather than twenty-four hours, the counter region CNTh is cleared at the step S43 when the counter region CNTh counts the period of twelve hours. If and when the decisions at the previously described steps S35 and S41 are NO, the program returns to the original operation routine. More specifically, the FIG. 9 routine functions as an interrupt routine each time the clock pulse Øm is obtained.

Figure 10A:
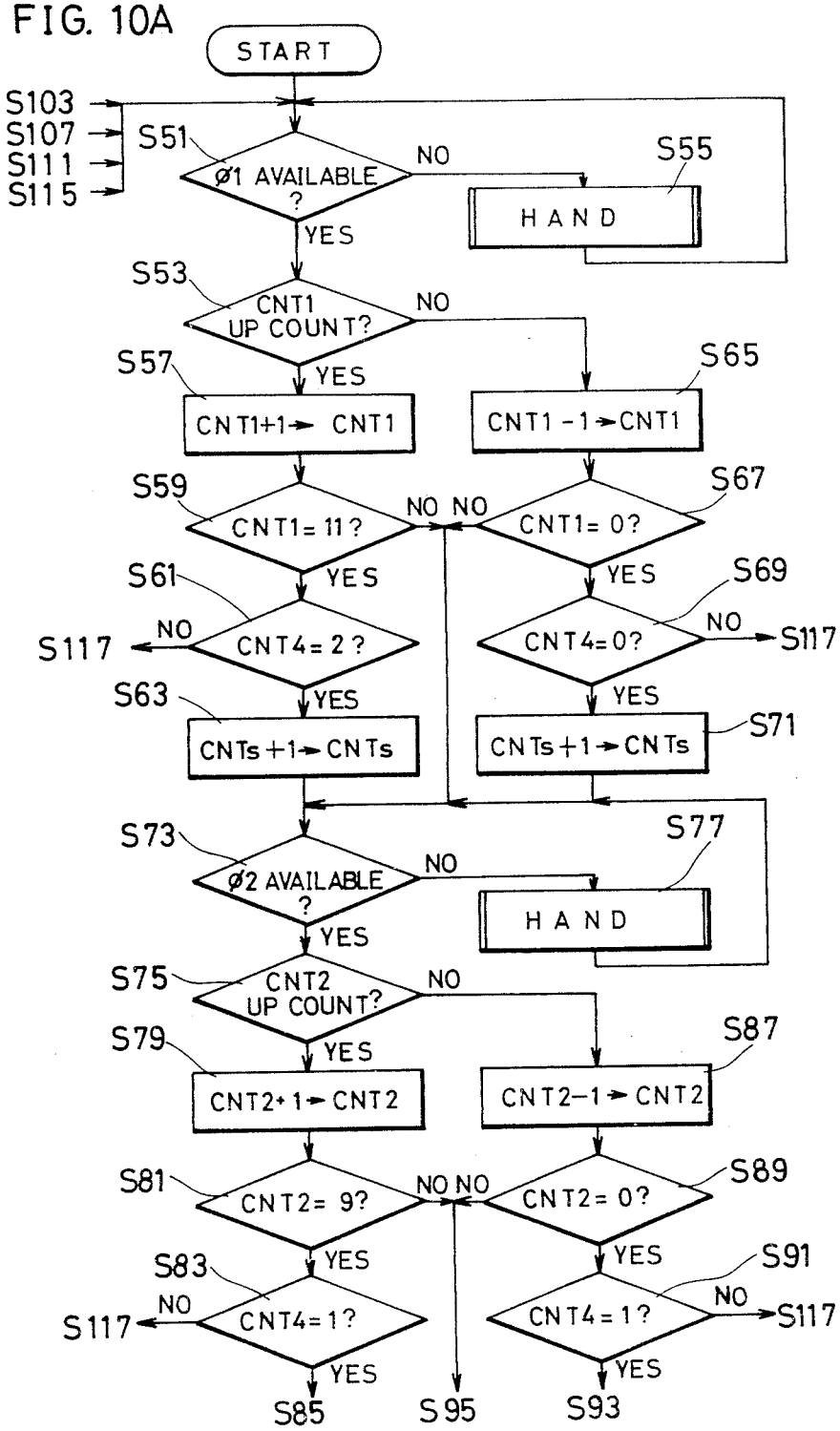
Figure 10B:
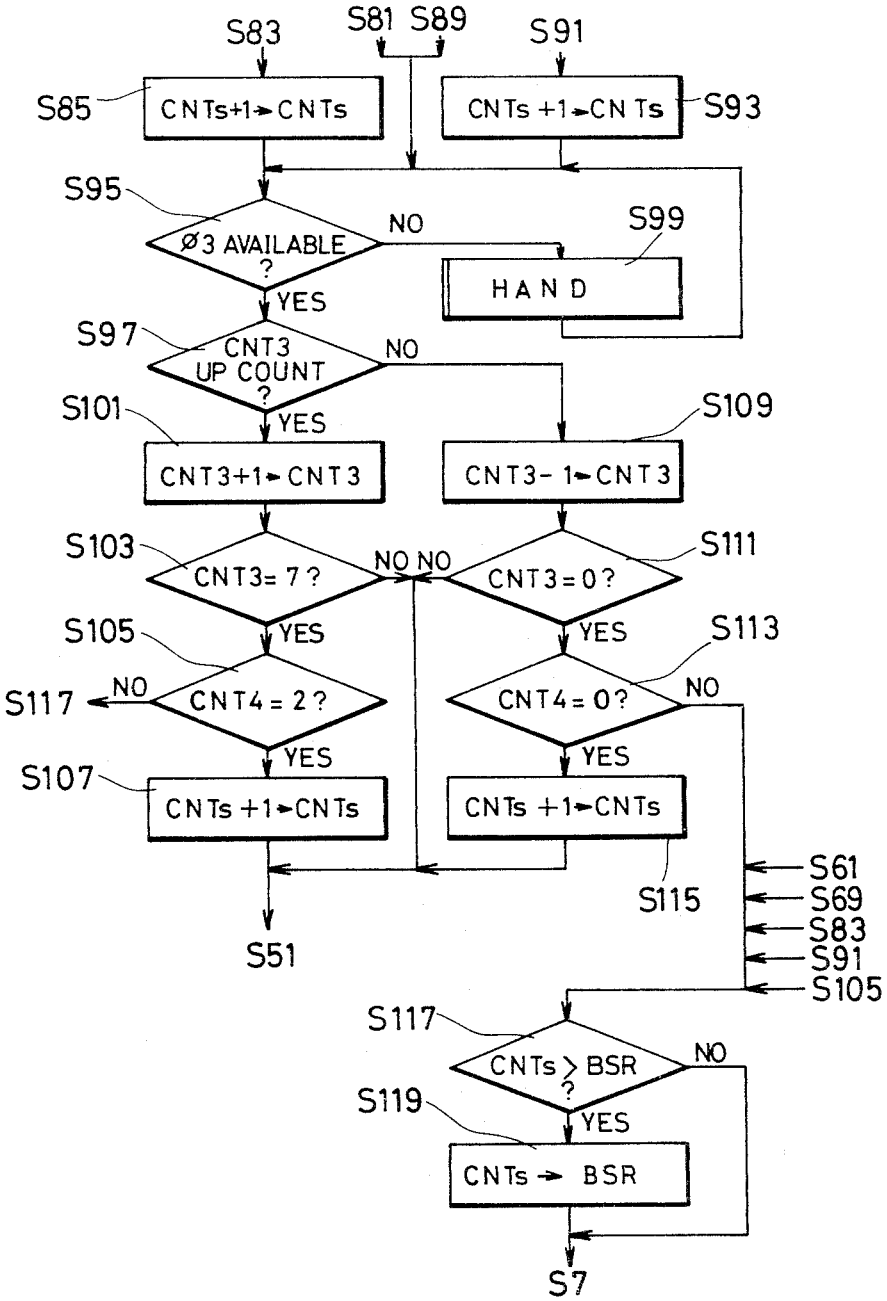

FIGS. 10A and 10B are flow diagrams showing the game routine previously shown in FIG. 7. Referring to FIGS. 7, 10A, 10B and 11, the operation of the present apparatus in the game mode will now be described. If and when the start switch 121 or 122 is turned on, the flag region FG of the random access memory 830 is set or reset, whereupon the content in the best score register BSR is displayed in the numerical value displaying region 21 of the display 20, whereby the best score in the past can be observed. The display of the best score is continued during the period of operation of the above described start switch 121 or 122 and, when the operation of the switch is released, the program enters into the subroutine shown in FIG. 10A. At the outset it is determined at the step S51 whether the clock pulse Ø1 is received from the clock generator 90. If it is determined that the clock pulse Ø1 is not received, then the program enters at the step S55 into a hand routine to be described below. If and when the clock pulse Ø1 is received, then at the step S53 it is determined whether the counter region CNT1 of the random access memory 830 is in the up count mode. More specifically, it is determined whether the ball symbol segments **24*a* to 24*l* of the segment group 24 are to be selectively activated in turn in the rightward direction (as viewed in FIG. 2) or selectively activated in turn in the opposite direction. In the case of the up count mode of the counter region CNT1, the counter region CNT1 is up counted in response to each clock pulse Ø1 at the step S57. Then at the following step S59 it is determined whether the content in the counter region CNT1 has reached the value "11". More specifically, it is determined whether the ball symbol segment 24*l* is activated for display. If and when the ball symbol segment 24*l* has been activated for display, then at the step S41 it is determined whether the counter region CNT4 is the value "2". More specifically, at that time it is determined whether the hand symbol segment 233 has been activated for display. If both decisions described above are YES, then at the following step S62 the score counter region CNTs is advanced. However, if it is determined at the step S53 that the counter region CNT1 of the random access memory 830 is in the down count mode, then at the following step S65 the counter region CNT1 is counted down in response to the clock pulse Ø1. Thereafter at the following step S67 it is determined whether the counter region CNT1 is "0", if so, then at the step S69 it is determined whether the counter region CNT4 is "0". If and when the decisions at these steps S67 and S69 are YES, then as in the case of the above described step S63**, the score counter region CNTs is advanced.

If and when the decisions at the steps S59 and S67 are NO and after the counter region CNTs is advanced, it is then determined whether the clock pulse Ø2 is received. After the clock pulse Ø2 has been received, substantially the same operation is repeated at the steps S73 to S93, as that in the above described steps S51 to S71. More specifically, at the steps S73 to S93, a figure pattern for a game by the segment groups 25 on the display 20 is controlled.

If and when the decisions at the steps S81 and S89 are NO and after the counter region CNTs is advanced at the steps S85 and S93, the program then proceeds to the step S95. At the step S95 it is determined whether the clock pulse Ø3 is received from the clock generator 90. If and when the clock pulse Ø3 is received, then substantially the same operation is repeated thereafter to the step S115 as the operation performed at the previously described steps S51 to S71. More specifically, at the steps S95 to S111, the game by the segment group 26 on the display 20 is controlled.

If and when the decisions at the steps S61, S69, S83, S91, S105 and S113 are all NO, then at the step S117 it is determined whether the score data of the current game in the counter region CNTs is larger than the best score data in the best score register BSR. If and when it is determined that the score of the current game exceeds the best score so far attained, the content in the register region MSR is updated by the content in the regions CNTs at the step S119. Thereafter the program returns to the previously described main routine.

Figure 11:
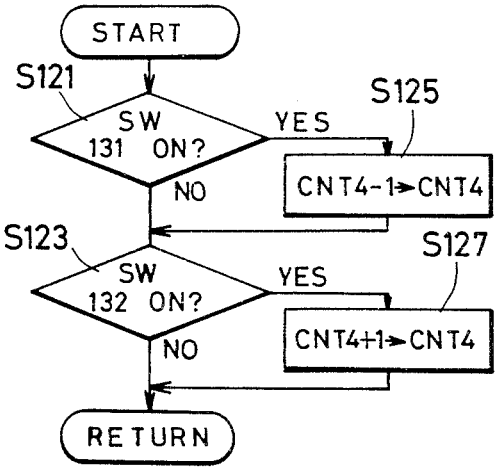

As shown in FIG. 11, the hand routine performs at the steps S121 to S127 an operation whereby, upon actuation of the game operation switch 131 the counter region CNT4 corresponding to the previously described trinary counter 309, is counted down and upon operation of the switch 132 the counter region CNT4 is counted up. Thus, the hand symbol segments on the display 20 can be properly selected.

Although FIGS. 10A and 10B depict the case where all the segment groups 24, 25 and 26 are activated, it is pointed out that upon actuation of the start switch 121 the operation at the steps S95 to S115 will be omitted. Upon termination of such game subroutine, the present apparatus returns to the timepiece mode, as is the same as the previously described hardware embodiment.

Figure 12:
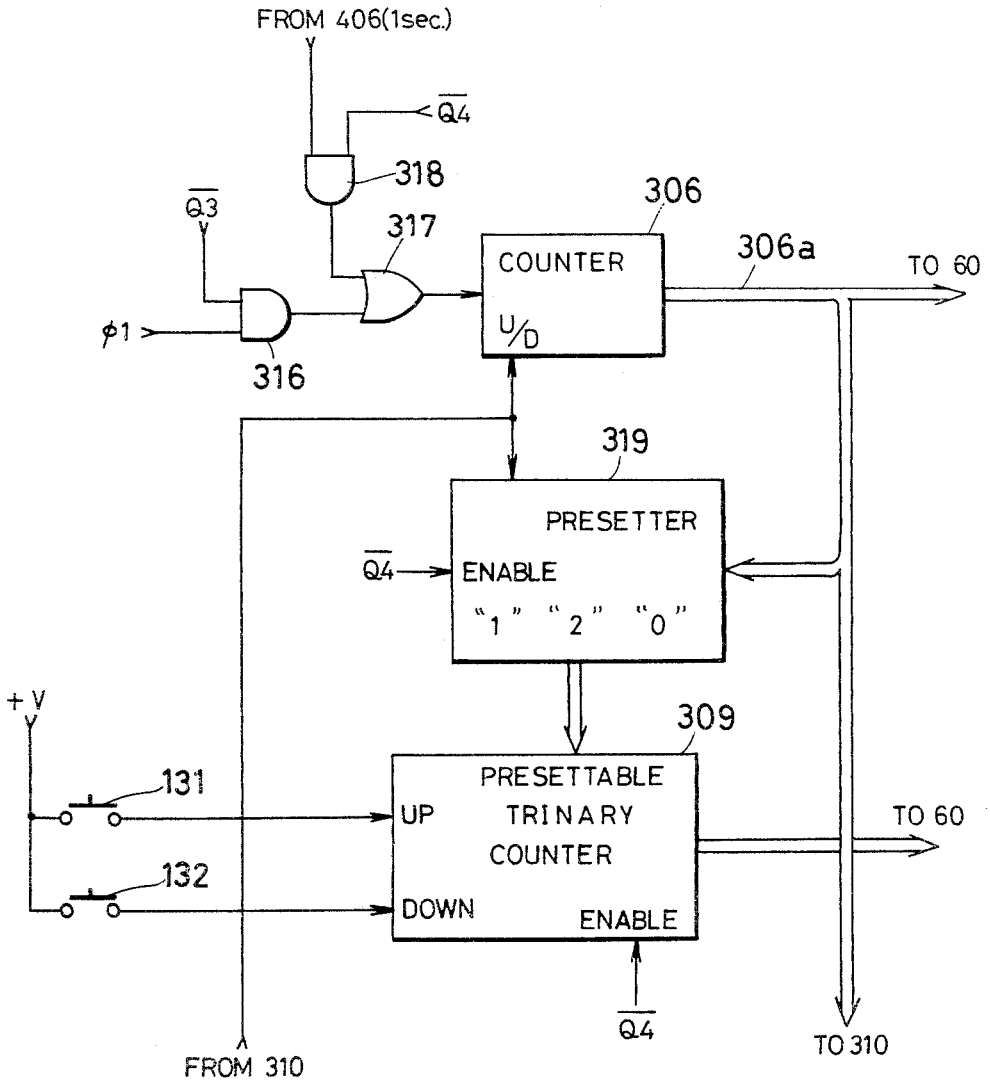
FIG. 12 is a flow diagram showing a major portion of another embodiment of the present invention.

FIG. 12 is a block diagram showing a major portion of another embodiment of the present invention. In any of the above described embodiments, no second indication was made in the timepiece mode. However, the embodiment of FIG. 12 enables a second indication as well as an hour indication and a minute indication in the timepiece mode and accordingly the FIG. 12 shows only a portion of interest, which may be employed in any of the previously described embodiments. The embodiment shown is constructed so that the clock pulse Ø1 or the second pulse obtained from the clock generator 406 included in the timepiece circuit 40 is applied to the count input of the counter 306 for the segment group 24 on the display 20. More specifically, the clock pulse Ø1 from the clock generator 305 and the output Q1 of the flip-flop 301 are applied to an AND gate 316. The output of the AND gate 316 is applied to one input of an OR gate 317. The second pulse and the output $\overline{Q4}$ of the flip-flop 401 are applied to an AND gate 318. The output of the AND gate 308 is applied to the other input of the OR gate 317. Accordingly, when the game mode is selected, the clock pulse Ø1 from the clock generator 305 is applied to the count input of an up/down counter 306, whereas when the timepiece mode is selected the second pulse from the clock generator 406 is applied to the count input of the up/down counter 306. The count value in the counter 306 is applied through the data bus 306*a* to the decoder/driver 60 and to the collision detecting circuit 310 and is also applied to a presetter 319 which is an essential feature of the embodiment shown. The presetter 319 is provided for presetting three numerical values, i.e., "0", "2" and "1" and may comprise a decoder. The presetter 319 is also supplied with the coincidence output from the collision detecting circuit 310 for the purpose of determining whether the counter 306 is in the up count mode or the down count mode. The presetter 319 is enabled in response to the output Q4 of the flip-flop 401 and, in the down count mode of the counter 306, when the content of the counter 306 becomes "1", the presetter 319 loads the numerical value "0" in the trinary reversible counter 309. To that end, the trinary counter 309 is constructed as a presettable counter and is preset and enabled in response to the output $\overline{Q4}$ of the flip-flop 401. In the up count mode of the counter 306, when the content in the counter 306 reaches "10", the presetter 319 preset loads the numerical value "2" in the trinary counter 309. In either count mode of the counter 306, when the content in the counter 306 reaches "5", the presetter 319 preset loads the numerical value "1" in the trinary counter 309.

Since the embodiment shown in constructed as described above, the display 20 performs substantially the same operation as described above in the game mode but provides a second indication by the segment group 24 in the timepiece mode. More specifically, in the timepiece mode, the second pulse is applied to the count input of the counter 306, so that the content in the counter 306 counts up or down for each second. Accordingly, the decoder/driver 60 receiving the above described count value activates the ball symbol segments 24*a* to 24*l* selectively in succession for each second. Thus the ball symbol segments are selectively activated in succession and when the ball symbol 24*b* is activated after the ball symbol segments are selectively activated in succession in the direction from 24*l* to 24*a*, the numerical value "0" is preset loaded in the trinary counter 309 by the presetter 319. Accordingly, the hand symbol segment 221 is activated for display at that time. Conversely, if and when the ball symbol segment 24*k* is activated for display after the ball symbol segments are selectively and in turn activated for display in the direction from 24*a* to 24*l*, the numerical value "2" is preset loaded in the trinary counter 309. As a result, the hand symbol segment 233 is activated for display at that time. Thus, in predetermined synchronism with the second indication by the ball symbol segments 24*a* to 24*l*, the hand symbol segments 221 or 233 are also activated for display. In the case of either the up count mode or the down count mode of the counter 306, when the ball symbol segment 24*f* is activated for display, the numerical value "1" is preset loaded in the trinary counter 309 by the presetter 319. Accordingly, at that time the middle hand symbol segments 222 and 232 are activated for display. Thus, according to the embodiment shown, in the timepiece mode of the apparatus a second indication can be made using the segments for use in displaying the figure for the purpose of the game mode. Although in the embodiment shown a second indication was made using the segment group 24 on the display 20, alternatively a second indication may be using the segment group 25 or the segment group 26. In making a second indication using the segment group 25, the second pulse may be applied to the counter 307. Since the segment group 25 comprises just ten ball symbol segments 25*a* to 25*j*, the moving direction of the activated ball symbol segment is changed every ten seconds and as a result a preferred embodiment is provided. In such a case, the apparatus may be merely adapted so that the hand symbol segments 222 and 232 are normally activated for display. It is pointed out that the embodiment of FIG. 12 can be embodied by employing a software implementation using the microprocessor or microcomputer of FIG. 6 instead of the hardware implementation as described in the foregoing.

Figure 13A:
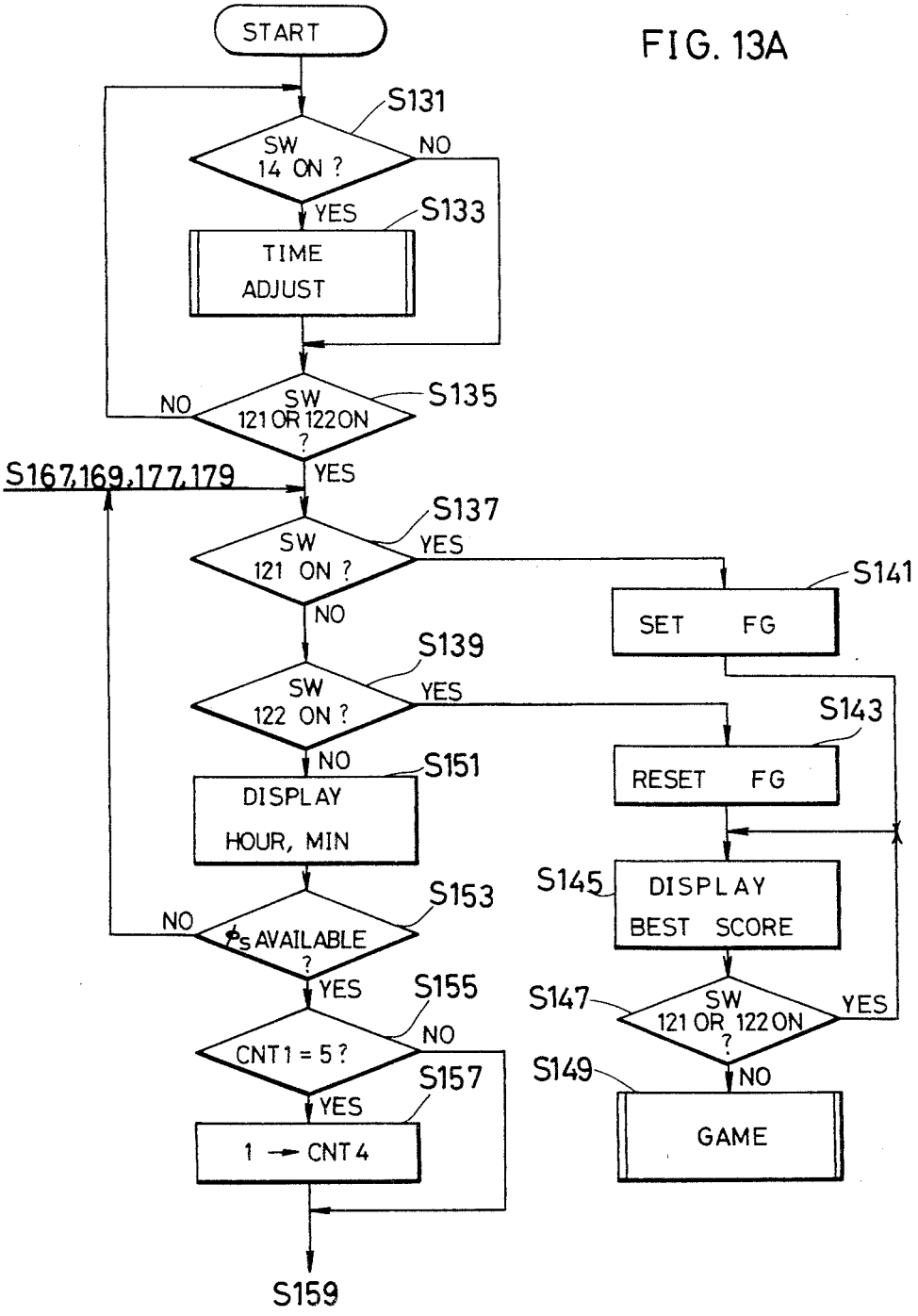
FIGS. 13A and 13B are flow diagrams for performing the same operation as in FIG. 12, but using the embodiment of FIG. 6.
Figure 13B:
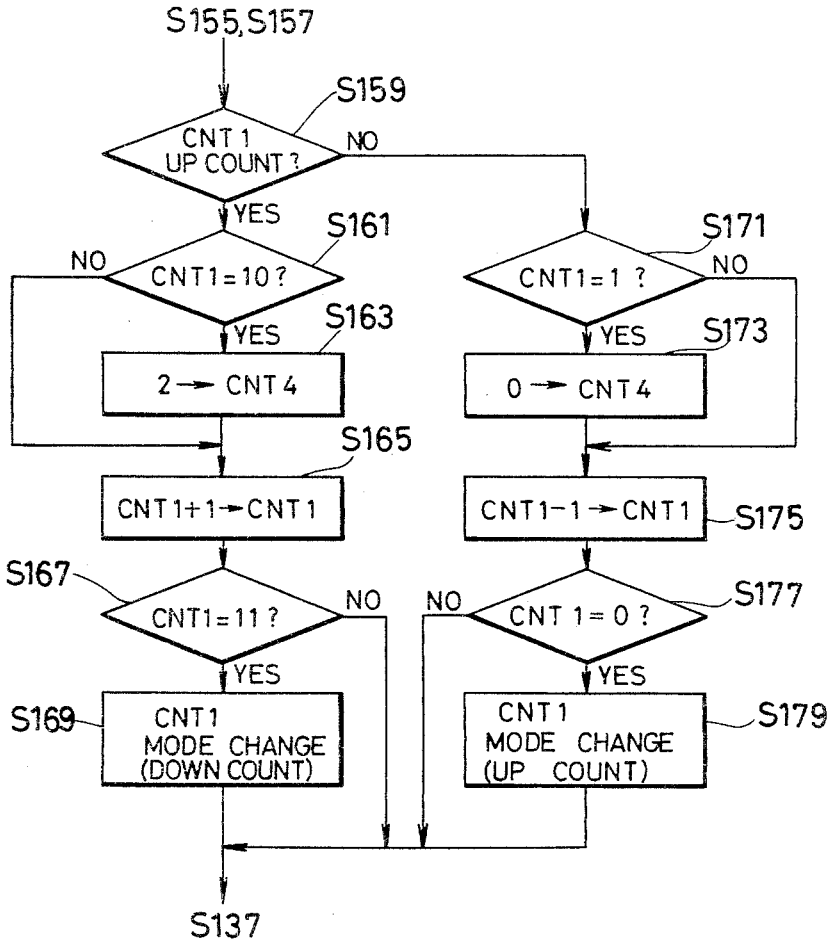

FIGS. 13A and 13B are flow diagrams for performing substantially the same control as is done in the embodiment of FIG. 12 using a microcomputer as shown in FIG. 6. With simultaneous reference to FIGS. 13A and 13B as well as 6, the embodiment of the flow diagrams shown will be described in the following. Since the respective steps S131, S133, S135, S137, S139, S141, S143, S145, S147 and S149 shown in FIG. 13A correspond to the respective steps S1, S3, S5, S7, S9, S13, S14, S15, S17 and S19 shown in FIG. 7 respectively, a detailed description of such steps will be omitted.

In the case where neither the start switch 121 nor 122 is turned on, the apparatus is in the timepiece mode and accordingly the "hour" information and the "minute" information in the regions CNTh and CNTm, respectively, are displayed in the numerical value display region 21 of the display 20, whereby the current time is displayed at the step S151. Then at the step S153 it is determined whether the second clock pulse Øs is obtained from the clock generator 90 (FIG. 6). The second clock pulse Øs may be the same as a one second clock pulse obtained from the clock generator 406 shown in FIG. 4B, for example. More specifically, in the embodiment shown, as in the case of the above described embodiment of FIG. 12 the arithmetic logical unit 80 receives the second clock pulse Øs from the clock generator 90 for indicating the second using the game displaying region. If and when the second clock pulse Øs is available, it is determined whether the region CNT1 is "5" at the step S155. More specifically, it is determined whether the ball symbol segment 24*f* has been displayed on the display 20. If it is determined that the ball symbol segment 24*f* has been displayed on the display 20, a "1" is loaded in the region CNT4 at the step S157. Accordingly, when the ball symbol segment 24*f* is displayed, only the middle ones 222 and 232 out of the hand symbol segments 221 to 223 and 231 to 233 are displayed. Thereafter, at the step S159 it is determined whether the region CNT1 is in the up count mode. More specifically, it is determined whether the ball symbol of the segment group 24 on the display 20 is moving leftward or rightward in FIG. 2. If and when the region CNT1 is in the up count mode, then the program shifts to the following step S161, while in the case of the down count mode the program shifts to the step S171.

At the step S161 it is determined whether the region CNT1 is "10". More specifically, it is determined whether the ball symbol segment 24*k* has been displayed. If the decision at the step S161 is YES, then a "2" is loaded in the region CNT4 at the step S163. More specifically, if the ball symbol segment 24*k* has been displayed at that time, then the corresponding hand symbol segment 233 is displayed to successfully receive the ball symbol. Thereafter the content in the region CNT1 is counted up by "1" at the step S165 and then it is determined whether the region CNT1 has become "11" at the step S167. When the ball symbol segment 241 at one end of the segment group is thus displayed, then the region CNT1 is placed in the down count mode at the step S169. Conversely, if and when the region CNT1 is in the down count mode at the step S169, then the program proceeds to the step S171.

At the step S171 it is determined whether the region CNT1 is "1". More specifically, it is determined whether the ball symbol segment 24*b* has been displayed. If the decision at the step S161 is YES, then "0" is loaded in the region CNT4 at the step S173. If the ball symbol segment 24*b* has been displayed at that time, the corresponding hand symbol segment 221 is displayed to successfully receive the ball symbol. Thereafter the content in the region CNT1 is counted down by "1" at the step S175 and then it is determined whether the region CNT1 has become "0" at the step S177. When the ball symbol segment 24*a* at one end of the segment group is thus displayed, then the region CNT1 is placed in the up count mode at the step S179. As a result, the same second indication as that in the embodiment of FIG. 12 is made.

The above described embodiments were adapted to use the numerical value displaying region 21 of the display 20 for the purpose of both indicating the current time information in the timepiece mode and indicating the score information in the game mode. Such embodiments are most preferred in practicing the present invention in that a single displaying region can be used for two purposes. However, a separate numerical value displaying region 21*a* may be provided as shown in FIG. 3, so that the current time information and the score information may be indicated separately by the numerical value indicating regions 21 and 21*a*. Furthermore, a further numerical value displaying region 21*b* may be provided for normally indicating only the best score. In such case, the display data selection circuit 50 might be dispensed with. However, a decoder/driver need be provided for each displaying region.

Although in the above described embodiments the clock generator 305 of FIG. 4A and the clock generator 90 of FIG. 6 were constructed so that the three-phase clock pulses Ø1, Ø2 and Ø3 are provided at the predetermined period T. Alternatively, means 305 may be provided for changing the period as shown in FIG. 4A. More specifically, the apparatus may be constructed so that the generation period of the clock pulses Ø1, Ø2 and Ø3 may be shortened or prolonged through selection by a player or automatically, so that selective and successive activation of the ball symbol segments may be quickened or slowed down whereby the game being played by the apparatus can be made more versatile. As another modification, the apparatus may be constructed so that the generation period of the clock pulses Ø1, Ø2 and Ø3 may be automatically changed depending on the content in the score counter 315 or in the counter region CNTs. For example, the clock pulses Ø1, Ø2 and Ø3 are generated at a predetermined period until the score reaches ten points, and the generation period of the clock pulses may be quickened when the score is from ten points to twenty points, and so on. Although the present invention has been described and illustrated in detail, it is clearly understood that the same is by way of illustration and example only and is not to be taken by way of limitation, the spirit and scope of the present invention being limited only by the terms of the appended claims.

We claim:

1. A timepiece apparatus having a game function, comprising: game associated information generating means for generating game associated information including at least a symbol indicating information for use in a game and including game operation means operable by a player for performing said game, current time information generating means for generating a current time information, said time information generating means including horological means for performing a horological function for said generating of a current time information, display means including game information displaying means for displaying said game associated information from said game associated information generating means, apparatus controlled symbol means adapted for being displayed by said display means for displaying at least a symbol having a movable or changeable configuration, and numerical value information displaying means for displaying said current time information from said current time information generating means in the form of at least a numerical value, mode selecting means for selecting for said display means a game displaying mode for displaying said game associated information or a current time displaying mode for displaying said current time information, and display control means responsive to the selection of said game displaying mode by said mode selecting means for displaying said game associated information, said display control means being further responsive to the selection of said current time displaying mode by said mode selecting means for displaying said current time information from said current time information generating means by said numerical value information displaying means, current time correcting means operatively connected to said horological means and responsive to said game operating means for correcting said current time information by using said game operation means when said current time displaying mode is selected by said mode selecting means, said apparatus further comprising player controlled symbol means adapted to be displayed on said display means for interacting with said apparatus controlled symbol means in response to an operation of said game operation means, means for imparting to said apparatus controlled symbol means different relative movements in a plurality of paths, and means for causing at least one of said apparatus controlled symbol means to assume a substantially unknown different relative movement to another of said apparatus controlled symbol means in said paths in response to a predetermined positional relationship between said one of said apparatus controlled symbol means and said player controlled symbol means.

2. A timepiece apparatus having a game function, comprising: game associated information generating means for generating game associated information including at least a symbol indicating information for use in a game and including game operation means operable by a player for performing said game, current time information generating means for generating a current time information, said time information generating means including horological means for performing a horological function for said generating of a current time information, display means including game information displaying means for displaying said game associated information from said game associated information generating means, and numerical value information displaying means for displaying said current time information from said current time information generating means in the form of at least a numerical value, mode selecting means for selecting for said display means a game displaying mode for displaying said game associated information or a current time displaying mode for displaying said current time information, and display control means responsive to the selection of said game displaying mode by said mode selecting means for displaying said game associated information, said display control means being further responsive to the selection of said current time displaying mode by said mode selecting means for displaying said current time information from said current time information generating means by said numerical value information displaying means, current time correcting mode setting means operatively coupled to said horological means for setting a current time correcting mode, and current time correcting means operatively connected to said horological means for correcting said current time information by using said game operation means when said current time correcting mode is set by said current time correcting mode setting means, said apparatus further comprising apparatus controlled symbol means adapted for being displayed by said display means, player controlled symbol means adapted to be displayed on said display means, said player controlled symbol means being able to interact with said apparatus controlled symbol means in response to an operation of said game operation means by a player, means for imparting to said apparatus controlled symbol means different relative movements in a plurality of paths, and means for causing at least one of said apparatus controlled symbol means to assume a substantially unknown different relative movement to another of said apparatus controlled symbol means in said paths in response to a predetermined positional relationship between said one of said apparatus controlled symbol means and said player controlled symbol means.

3. The timepiece apparatus of claim 2, wherein said game associated information generating means comprises score evaluating means for evaluating score information concerning a score attained as a function of the progress of said game, and wherein said game information displaying means comprises a score displaying region for displaying said score information from said score evaluating means.

4. The timepiece apparatus of claim 3, wherein said score displaying region comprises a numerical value information displaying portion.

5. The timepiece apparatus of claim 3, wherein said score displaying region and said numerical value information displaying means form a common display, and wherein said display control means is responsive to selection of said game mode by said mode selecting means for displaying said score information from said score evaluating means by said numerical value information displaying means.

6. The timepiece apparatus of claim 5, wherein said display control means is adapted to be responsive to an operation of said game operation means for displaying said score information by said numerical value information displaying means.

7. The timepiece apparatus of claim 3, wherein said score evaluating means comprises best score information storing means for storing the best of the scores attained among the preceding games, wherein said score displaying region comprises a best score displaying region, and wherein said display control means is adapted to be responsive to the selection of said game displaying mode by said mode selecting means for displaying said best score information from said best score information storing means by said best score displaying region.

8. The timepiece apparatus of claim 7, wherein said best score displaying region and said score displaying region form a common display, wherein said mode selecting means comprises operation means for enabling said game displaying mode, and wherein said display control means is adapted to be responsive to an operation of said game operation means for displaying said best score information from said best score information storing means by said score displaying region and then displaying said score information of the present game from said score information evaluating means by said score displaying region.

9. The timepiece apparatus of claim 8, wherein said score displaying region and said numerical value information displaying means form a common display, said display control means being operatively connected to be responsive to an operation of said game operation means for displaying said best score information from said best score information storing means by said numerical value information displaying means and then displaying said score information from said score information evaluating means by said numerical value information displaying means, and which further comprises game termination detecting means for detecting a termination of a game, said display control means being adapted to be responsive to detection of said game termination by said termination detecting means for displaying the current time information from said current time information generating means by said numerical value information displaying means.

10. The timepiece apparatus of claim 9, wherein said termination detecting means comprises continuation incapability detecting means for detecting that a game cannot be continued.

11. The timepiece apparatus of claim 10, wherein said termination detecting means comprises time lapse determining means for determining whether a predetermined time period has lapsed after detection by said game continuation incapability detecting means of an incapability for continuation of a game, and wherein said display control means displaying said current time information are responsive to the lapse of said predetermined time period.

12. The timepiece apparatus of claim 2, wherein said game information displaying means is constructed for movably displaying said symbol, and wherein said game associated information generating means comprises game symbol operation means for providing an apparent movement of said symbol on said game information displaying means.

13. The timepiece apparatus of claim 12, wherein said game information displaying means comprises a plurality of display segments for displaying said symbol, and which further comprises first segment selective activating means responsive to an operation of said game symbol operation means for activating at least one out of said plurality of display segments.

14. The timepiece apparatus of claim 13, wherein said game associated information generating means comprises score evaluating means responsive to a selective activation of said display segments by said first segment selective activating means for evaluating the score of said game.

15. The timepiece apparatus of claim 14, which further comprises symbol varying signal generating means for generating a symbol varying signal causing a variation of said symbol on said game information displaying means, and second segment selective activating means responsive to said figure varying signal from said symbol varying signal generating means for displaying at least one out of said plurality of display segments, said score evaluating means including relation determining means for stepping said score if and when a predetermined relation is established between said first display segment selectively activated by said first segment selective activating means and said second display segment selectively activated by said second segment selective activating means.

16. The timepiece apparatus of claim 15, wherein said symbol varying signal generating means comprises synchronizing signal generating means for generating a synchronizing signal for establishing a predetermined synchronization.

17. The timepiece apparatus of claim 16, wherein said relation determining means is adapted to determine when an apparent collision occurs on said game information displaying means between said first display segment and said second display segment.

18. The timepiece apparatus of claim 17, wherein said game symbol operation means comprises at least one operation switch adapted to be responsive to a selection of said current time displaying mode for changing said current time by said horological means.

19. The timepiece apparatus of claim 18, wherein said game symbol operation means comprises at least two operation switches, and wherein said horological means comprises an hour horological portion and a minute horological portion, one of said operation switches being adapted to act on said hour horological portion and the other operation switch being adapted to act on said minute horological portion.

20. The timepiece apparatus of claim 19, wherein said hour horological portion is responsive to each operation of said one operation switch for advancing said current time information on an hour basis and wherein said minute horological portion is responsive to each operation of said other operation switch for advancing said current time information on a minute basis.

21. The timepiece apparatus of claim 2, wherein said current time information generating means comprises periodic signal generating means for generating a periodic signal for a predetermined length of time, wherein said game information display means comprises a symbol segment for displaying said symbol, said apparatus further comprising second segment activating means responsive to selection of said current time displaying mode by said mode selecting means for activating said symbol segment as a function of said periodic signal obtained from said periodic signal generating means.

22. The timepiece apparatus of claim 21, wherein said symbol segment comprises a plurality of symbol segment components, and wherein said second segment activating means is adapted to activate selectively and in succession said plurality of symbol segment components as a function of said periodic signal.

23. The timepiece apparatus of claim 22, wherein said plurality of symbol segment components are arranged in a line, and wherein said second segment activating means is adapted to activate in succession and selectively one of said plurality of symbol segment components arranged in a line.

24. The timepiece apparatus of claim 23, wherein said plurality of symbol segment components arranged in a line comprise a predetermined number of segment components, and wherein said second segment activating means comprises direction reversing means for reversing the direction of said successive and selective activation of said plurality of symbol segment components when said selectively activated symbol segment component reaches the end of a segment group.

25. The timepiece apparatus of claim 24, wherein said game information display means comprises two other symbol segments corresponding to both ends of said symbol segment components arranged in a line, and wherein said second segment activating means is adapted to selectively display the corresponding one out of said two other figure segments when said figure segment at the end is activated for display.

26. The timepiece apparatus of claim 21, wherein said periodic signal generating means is adapted to generate a one-second signal for each period.

27. The timepiece apparatus of claim 2, wherein said horological means includes a clock signal source and current time information storing means for storing current time information, and wherein said current time correcting means are responsive to operation of said game operation means for incrementing said current time information storing means when said current time correction mode is set.

28. The timepiece apparatus of claim 27, wherein said clock source includes an oscillator and a frequency divider for dividing the frequency of an output of said oscillator, and wherein said incrementing means is adapted to apply an output of said frequency divider to said current time information storing means in response to said operation of said game operation means.

29. A timepiece apparatus having a game function, comprising: game associated information generating means for generating game associated information including at least a symbol indicating information for use in a game, said game associated information generating means comprising score evaluating means for evaluating score information concerning a score attained as a function of the progress of said game, best score information storing means for storing the best of the scores attained by preceding games, current time information generating means for generating a current time information, display means including game information displaying means for displaying said game associated information from said game associated information generating means for displaying at least a symbol, and numerical value information displaying means for displaying said current time information from said current time information generating means in the form of at least a numerical value, mode selecting means for selecting for said display means a game displaying mode for displaying said game associated information or a current time displaying mode for displaying said current time information, game start signal providing means for providing a game start signal for initiating said game associated information generating means, and display control means responsive to the selection of said game displaying mode by said mode selecting means for applying said best score information from said best score information storing means to said numerical value information displaying means, said display control means being further responsive to said game start signal for applying said score information to said numerical value information displaying means, said display control means being further responsive to the selection of said current time displaying mode for applying said current time information to said numerical value displaying means, whereby a single numerical value displaying region is used on a time sharing basis as the current time display region, as the score point displaying region and as the best score displaying region, said apparatus further comprising apparatus controlled symbol means adapted for being displayed by said display means, game operation means operable by a player for playing a game, player controlled symbol means adapted to be displayed on said display means, said player controlled symbol means being able to interact with said apparatus controlled symbol means in response to an operation of said game operation means, means for imparting to said apparatus controlled symbol means different relative movements in a plurality of paths, and means for causing at least one of said apparatus controlled symbol means to assume a substantially unknown different relative movement to another of said apparatus controlled symbol means in said paths in response to a predetermined positional relationship between said one of said apparatus controlled symbol means and said player controlled symbol means.

30. The timepiece apparatus of claim 27, wherein said game information displaying means is constructed for movably displaying said symbol, and wherein said game associated information generating means comprises game symbol operation means for providing an apparent movement of said figure on said game information displaying means.

31. The timepiece apparatus of claim 30, wherein said game information displaying means comprises a plurality of display segments for displaying said symbol, and which further comprises first segment selective activating means responsive to operation of said game symbol operation means for activating at least one out of said plurality of display segments.

32. The timepiece apparatus of claim 31, wherein said game associated information generating means comprises score evaluating means responsive to a selective activation of said display segments by said first segment selective activating means for evaluating the score of said game.

33. The timepiece apparatus of claim 32, which further comprises symbol varying signal generating means for generating a symbol varying signal causing a variation of said symbol on said game information displaying means, and second segment selective activating means responsive to said symbol varying signal from said symbol varying signal generating means for displaying at least one out of said plurality of display segments, said score evaluating means including relation determining means for stepping said score if and when a predetermined relation is established between said first display segment selectively activated by said first segment selective activating means and said second display segment selectively activated by said second segment selective activating means.

34. The timepiece apparatus of claim 29, which further comprises game termination detecting means for detecting a termination of a game, wherein said termination detecting means comprises continuation incapability detecting means for detecting that a game cannot be continued.

35. The timepiece apparatus of claim 34, wherein said termination detecting means comprises time lapse determining means for determining whether a predetermined time period has lapsed after detection of incapability for continuation of a game, and wherein said display control means displaying said current time information are responsive to the lapse of said predetermined time period.

36. A timepiece apparatus having a game function, comprising: game associated information generating means for generating game associated information including at least a symbol indicating information for use in a game, current time information generating means for generating current time information, display means including game information displaying means having a plurality of display segments for displaying said game associated information from said game associated information generating means, said display means displaying at least a symbol, and numerical value information displaying means for displaying said current time information from said current time information generating means in the form of at least a numerical value, mode selecting means for selecting for the display means, a game displaying mode for displaying said game associated information or a current time displaying mode for displaying said current time information, display control means responsive to the selection of said game displaying mode by said mode selecting means for displaying said game associated information, said display control means being further responsive to the selection of said current time displaying mode by said mode selecting means for displaying said current time information from said current time information generating means by said numerical value information displaying means, symbol varying signal generating means for generating a figure varying signal causing a variation of said symbol on said game information displaying means, and segment selective activating means responsive to said symbol varying signal from said symbol varying signal generating means for displaying at least one out of said plurality of display segments when said current time displaying mode is selected by means of said mode selecting means, said apparatus further comprising apparatus controlled symbol means adapted for being displayed by said display means, game operation means operable by a player for playing a game, player controlled symbol means adapted to be displayed on said display means, said player controlled symbol means being able to interact with said apparatus controlled symbol means in response to an operation of said game operation means by a player, means for imparting to said apparatus controlled symbol means different relative movements in a plurality of paths, and means for causing at least one of said apparatus controlled symbol means to assume a substantially unknown different relative movement to another of said apparatus controlled symbol means in said paths in response to a predetermined positional relationship between said one of said apparatus controlled symbol means and said player controlled symbol means.

37. The timepiece apparatus of claim 36, wherein said game information displaying means is constructed for movably displaying said symbol, and wherein said game associated information generaing means comprises game symbol operation means for providing an apparent movement of said symbol on said game information displaying means.

38. The timepiece apparatus of claim 37, wherein said game information displaying means comprises a plurality of display segments for displaying said symbol, and which further comprises first segment selective activating means responsive to operation of said game symbol operation means for activating at least one out of said plurality of display segments.

39. The timepiece apparatus of claim 38, wherein said game associated information generating means comprises score evaluating means responsive to a selective activation of said display segments by said first segment selective activating means for evaluating the score of said game.

40. The timepiece apparatus of claim 39, wherein said score evaluating means include relation determining means for stepping said score if and when a predetermined relation is established between said first display segment selectively activated by said first segment selective activating means and a second display segment selectively activated by second segment selective activating means.

41. The timepiece apparatus of claim 40, wherein said symbol varying signal generating means comprises synchronizing signal generating means for generating a synchronizing signal for establishing a predetermined synchronization.

42. The timepiece apparatus of claim 41, wherein said relation determining means is adapted to determine when an apparent collision occurs on said game information displaying means between said first display segment and said second display segment.

43. The timepiece apparatus of claim 36, wherein said current time information generating means comprises periodic signal generating means for generating a periodic signal for a predetermined length of time, wherein said game information display means comprises a symbol segment for displaying said figure, said apparatus further comprising second segment activating means responsive to selection of said current time displaying mode by said mode selecting means for activating said symbol segment as a function of said periodic signal obtained from said periodic signal generating means.

44. The timepiece apparatus of claim 43, wherein said symbol segment comprises a plurality of symbol segment elements, and wherein said second segment activating means is adapted to activate selectively and in succession said plurality of symbol segment elements as a function of said periodic signal.

45. The timepiece apparatus of claim 44, wherein said plurality of symbol segment elements are arranged in a line, and wherein said second segment activating means is adapted to activate in succession and selectively one of said plurality of symbol segment elements arranged in a line.

46. The timepiece apparatus of claim 45, wherein said plurality of symbol segment elements arranged in a line comprise a predetermined number of segment elements, and wherein said second segment activating means comprises direction reversing means for reversing the direction of said successive and selective activation of said plurality of symbol segment elements when said selectively activated symbol segment element reaches the end of a segment group.

47. The timepiece apparatus of claim 46, wherein said game information display means comprises two other symbol segments corresponding to both ends of said symbol segment elements arranged in a line, and wherein said second segment activating means is adapted to selectively display the corresponding one out of said two other symbol segments when said symbol segment at the end is activated for display.

48. The timepiece apparatus of claim 43, wherein said period signal generating means is adapted to generate a one-second signal for each period.

* * * * *

UNITED STATES PATENT AND TRADEMARK OFFICE

CERTIFICATE OF CORRECTION

PATENT NO. : 4,438,926

DATED : March 27, 1984

INVENTOR(S) : Gunpei Yokoi et al

It is certified that error appears in the above-identified patent and that said Letters Patent is hereby corrected as shown below:

In the cover page, "48 Claims, 16 Drawing Figures" should Read: --48 Claims, 17 Drawing Figures--.

Claim 15, column 23, line 59, "figure" should be --symbol--.

Claim 37, column 27, line 46, "generaing" should read: --generating--.

Signed and Sealed this

*Eleventh* Day of *December 1984*

[SEAL]

*Attest:*

GERALD J. MOSSINGHOFF

*Attesting Officer* *Commissioner of Patents and Trademarks*